US007872609B2

(12) United States Patent
Ou et al.

(10) Patent No.: US 7,872,609 B2
(45) Date of Patent: Jan. 18, 2011

(54) CIRCULAR WAVEGUIDE ANTENNA AND CIRCULAR WAVEGUIDE ARRAY ANTENNA

(75) Inventors: Hok Huor Ou, Kanagawa (JP); Seiji Nishi, Tokyo (JP); Hiroyo Ogawa, Kanagawa (JP); Kiyoshi Hamaguchi, Kanagawa (JP); Yozo Shoji, Kanagawa (JP)

(73) Assignees: Oki Electric Industry Co., Ltd., Tokyo (JP); National Institute of Information and Communications Technology, Incorporated Administrative Agency, Tokyo (JP)

( * ) Notice: Subject to any disclaimer, the term of this patent is extended or adjusted under 35 U.S.C. 154(b) by 1001 days.

(21) Appl. No.: 11/656,567

(22) Filed: Jan. 23, 2007

(65) Prior Publication Data

US 2010/0231475 A1 Sep. 16, 2010

(30) Foreign Application Priority Data

Jan. 23, 2006 (JP) ..... 2006-013624

(51) Int. Cl.
*H01Q 13/00* (2006.01)

(52) U.S. Cl. ..... 343/776; 343/772; 343/786

(58) Field of Classification Search ..... 343/772, 343/776, 786

See application file for complete search history.

(56) References Cited

U.S. PATENT DOCUMENTS 6,924,169 B2 * 8/2005 Moon et al. ..... 438/73
7,057,572 B2 * 6/2006 Lee et al. ..... 343/786

FOREIGN PATENT DOCUMENTS

JP 2000-353916 12/2000

OTHER PUBLICATIONS

"Millimeter-Wave Ad-Hoc Wireless Access System II: (7) 70 GHz Circular Polarization Antenna", Seiji Nishi, Yozo Shoji and Hiroyo Ogawa: Technical Digest, 5th Topical Symposium on Millimeter Waves TSMMW2003, pp. 65-68, Mar. 2003, Kanagawa, Japan.

"A Wireless Video Home-Link Using 60 GHz Band: a Proposal of Antenna Structure", Seiji Nishi, Kiyoshi Hamaguti, Toshiaki Matui, Hiroyo Ogawa: Proc., 30th European Microwave Conference, vol. 1, pp. 305-308, Oct. 2000, Paris, France.

"Development of Millimeter-Wave Video Transmission System II: Antenna Development", Seiji Nishi, Kiyoshi Hamaguti, Toshiaki Matui, Hiroyo Ogawa: Technical Digest, 3rd Topical Symposium on Millimeter Waves TSMMW2001, pp. 207-210, Mar. 2001, Kanagawa, Japan.

* cited by examiner

*Primary Examiner*—Hoang V Nguyen
(74) *Attorney, Agent, or Firm*—Rabin & Berdo, PC

(57) ABSTRACT

A low-cost, compact circular waveguide array antenna which improves an antenna reflection loss characteristic and enables an improvement in radiation characteristics, particularly radiation gain. The circular waveguide array antenna includes feeding portions which feed electromagnetic waves to one ends of circular waveguides and radiation apertures which radiate the electromagnetic waves at the opposite ends. Each circular waveguide includes a conical horn, with a diameter of a feeding side aperture at the feeding portion end being a, a diameter of the radiation aperture being d, which is larger than the diameter a of the feeding side aperture, and an opening angle being $2\alpha$. If a wavelength of a central frequency of an employed frequency band is $\lambda$, then a value of $\alpha$, which is half of the opening angle $2\alpha$, is set between $0.8\times\text{Arcsin}(0.1349114/(d/\lambda))$ and $1.2\times\text{Arcsin}(0.1349114/(d/\lambda))$.

21 Claims, 30 Drawing Sheets

CIRCULAR WAVEGUIDE ANTENNA AND CIRCULAR WAVEGUIDE ARRAY ANTENNA

BACKGROUND OF THE INVENTION

1. Field of the Invention

The present invention relates to a circular waveguide antenna and a circular waveguide array antenna.

2. Description of the Related Art

Ordinarily, because reciprocal relationships are established at an antenna, transmission characteristics and reception characteristics are identical. Therefore, descriptions given hereafter are described for cases of transmission unless otherwise stated, and because cases of reception are the same, descriptions thereof will not be given.

In recent years, with the remarkable development of wireless communications technologies, there have been growing shortages of frequency bands to be assigned to various communication devices. In order to compensate for this, technological developments which are necessary to transfer effective utilization of frequencies to higher ranges have become an urgent matter. For example, millimeter waves, which have conventionally been used virtually only for basic research, have come to be used for highway transport systems (ITS: Intelligent Transport System). In the near future, as with household electronics, automobile companies in Japan, Europe, America, etc. can expect explosive growth in the use of millimeter wave-based communication devices.

In the field of millimeter-wave communications as mentioned above, obviously, it will be essential to adapt various components and apparatuses for millimeter waves. Among these, the one apparatus which is most important for millimeter-wave communications is the antenna. Without an antenna capable of transmitting and/or receiving millimeter-wave signals, millimeter-wave communications cannot be established. Currently, research institutions and manufacturers around the world who are participating in research and development of millimeter-wave communications are competing to develop millimeter-wave antennas with high levels of functionality. Hitherto, millimeter-wave antennas with various structures have been developed, and among these one millimeter-wave antenna with particularly excellent characteristics is the circular waveguide array antenna.

Next, an example of a previously known circular waveguide array antenna will be described. Firstly though, an example of a common circular waveguide antenna which structures a circular waveguide antenna array will be described.

The circular waveguide antenna is structured with a feeding portion and a radiating portion. There are various kinds of feeding portion, but the radiating portion is formed of a conductor in a tubular shape. A diameter and length thereof are determined by the wavelength employed, a state of matching with the feeding portion, and radiation directional characteristics. The higher an employed frequency is—that is, the shorter a wavelength λ is—the smaller the diameter of a tube of the radiating portion is, and the more difficult is machining of the feeding portion and the radiating portion.

FIGS. 30A and 30B show an example of structure of a previously known circular waveguide antenna. FIG. 30A is a perspective view and FIG. 30B is a sectional perspective view. A circular waveguide 31 is cut to a certain length, and is electrically connected with a dielectric sheet 32, which is provided with a conductive film, and earthed. A dielectric sheet 33 and the dielectric sheet 32 sandwich a stripline 34, which is a propagation path, and form the stripline 34. The stripline 34 has the function of propagating electric signals, extends to the middle of the circular waveguide 31, and structures the circular waveguide antenna.

A stripline distal end 36 of the stripline 34 is exposed at a central portion of the circular waveguide 31. An exposed length thereof and the diameter of the circular waveguide 31 determine impedance of the antenna. A dielectric exposure portion of the dielectric sheet 32 provided with the conductive film has the conductive film removed therefrom, to match a lower portion opening of the circular waveguide 31. The dielectric exposure portion covers the stripline distal end 36, and structures a feeding portion 37.

Ordinarily, electromagnetic waves radiate up and down from the stripline distal end 36. A cylindrical cavity 38 with a diameter the same as the circular waveguide 31 is formed in a conductor plate 35 such that it will not be the case that only half of the electromagnetic waves are irradiated from an upper portion opening of the circular waveguide 31. The cylindrical cavity 38 matches the lower portion opening of the circular waveguide 31 and is provided directly therebelow. A surface of the cylindrical cavity 38 is subjected to a surface treatment so as to be highly reflective of the electromagnetic waves that are employed.

A depth of the cylindrical cavity 38 is approximately a quarter of a wavelength in the guide λg for a central frequency of the employed frequency band. Accordingly, electromagnetic waves which radiate downward from the stripline distal end 36 are propagated a distance of λg/4, and completely reflected upon reaching a lower face of the cylindrical cavity 38. A phase inversion of 180° occurs thereat, and then the waves are again propagated the distance of λg/4 and return to the stripline distal end 36.

Thus, a propagation distance of the electromagnetic waves which radiate downward from the stripline distal end 36 is λg/2 (=λg/4+λg/4), and the phase inversion of 180° due to the total reflection corresponds to a further propagation of λg/2. Thus, the electromagnetic waves which are totally reflected at the lower face of the cylindrical cavity 38 and return therefrom are in phase with the electromagnetic waves which radiate upward from the stripline distal end 36, and efficient radiation from the upper portion opening of the circular waveguide 31 results.

Now, if a polarization plane of the radiated electromagnetic waves and a degree of stability are considered, a wavelength λ of the central frequency and a diameter a of the circular waveguide 31 are selected such that a propagation mode of the electromagnetic waves in the circular waveguide 31 is a basic mode TE11. In order to maintain the TE11 mode, the employed wavelength λ must be smaller than a cutoff wavelength λc (=3.412a) of the TE11 mode.

With such a structure, in accordance with machining of the stripline distal end 36, the circular waveguide antenna can be formed as a circular waveguide antenna for linearly polarized waves or a circular waveguide antenna for circularly polarized waves.

Further, the conventional circular waveguide antenna as described above may be formed in a single plate (see, for example, Non-patent Reference 1).

If such a circular waveguide antenna is plurally arranged to form an array device, a circular waveguide array antenna is obtained. If, for example, the antennas are arranged with equal spacings over a planar area, an antenna with radiation characteristics substantially equivalent to an aperture antenna with an aperture corresponding to the area of arrangement can be obtained.

Further, an array antenna is an antenna system in which a plurality of antennas are arranged in a pattern and which is capable of providing characteristics which cannot be provided by a single antenna. Further still, by controlling phases of the respective element antennas structuring an array antenna, it is possible to control directional characteristics of the overall antenna system, and thus it is possible to utilize the array antenna as a beam-scanning antenna without the main body of the antenna being mechanically moved.

As the name indicates, a circular waveguide array antenna is an array antenna in which a plurality of the conventional circular waveguide antenna are arranged in a certain pattern to serve as element antennas. The circular waveguide antennas are antennas in which the circular waveguides are cut off to certain dimensions and these are provided with excitation sections, and the cut-off openings serve as apertures.

A desired electric field distribution in a certain region can be obtained in accordance with the dimensions and arrangement of the circular waveguide antennas. For example, a plurality of circular waveguide antennas are two-dimensionally arranged in a planar region, and an electric field distribution with uniform direction, phase and amplitude can be obtained. Radiation characteristics of such an antenna are in theory substantially the same as radiation characteristics of an aperture antenna with a uniform electric field distribution, but such an antenna is more excellent than an aperture antenna in terms of freedom of structure and uniformity of the electric field distribution.

In a conventional two-dimensional array antenna, the element antennas which structure the array antenna are connected with a signal source by linked propagation paths, and the propagation paths are connected with the signal source or a feeding port of the array antenna.

At the same time, the propagation paths fulfill the role of phase devices, and lengths of the propagation paths from the signal source to the respective element antennas determine phases of the electromagnetic waves which are radiated from the respective element antennas, which affects radiation characteristics of the array antenna as a whole. Depending on the case, when phase adjustment is necessary, phase devices may be further added in series with the propagation paths (see, for example, Patent Reference 1).

Next, an example of a previously known circular waveguide array antenna in which the circular waveguide antenna described above is plurally arranged as array elements will be described.

FIG. 31A is a perspective view and FIG. 31B is an exploded perspective view of the above-mentioned circular waveguide array antenna.

A radiation plane of the antenna is a circular waveguide plate 41 which is machined with circular waveguides, which act as upper portion openings of the array elements, in a square region with equal spacings. Openings 42 of the array elements and screw holes 43, which are required when assembling the antenna and when fixing the antenna to other apparatus, are formed in the circular waveguide plate 41.

At a rear side of the circular waveguide plate 41 from the radiation plane, a stripline circuit sheet 44, an electromagnetic wave reflection plate 45 and a feeding port plate 46 are provided, and are respectively electrically connected by bolts or the like. The stripline circuit sheet 44 is for feeding the circular waveguides. The electromagnetic wave reflection plate 45 returns electromagnetic waves, which are radiated from distal ends of (feeding) striplines 47 of the stripline circuit sheet 44 when the same are feeding the openings 42 of the array elements, to the upper portion openings. The feeding port plate 46 feeds a common terminal of the feeding striplines.

At the stripline circuit sheet 44, the striplines 47 provided thereon are sandwiched by sheets of dielectric material, and the circular waveguide plate 41 and the electromagnetic wave reflection plate 45 are not directly connected electrically. An upper dielectric sheet, which is at lower portions of respective circular waveguides 410 of the circular waveguide plate 41, is removed at portions with dimensions exactly the same as the circular waveguides 410, to expose just distal end portions of the striplines 47, and electromagnetic waves can be radiated with ease.

This is a structure matching the circular waveguide antenna described with FIGS. 30A and 30B, and is a structure such that feeding terminals of all the striplines 47, which are guided to the lower portions of all the circular waveguides 410 of the circular waveguide plate 41, are structured as described in Non-patent Reference Document 1. The feeding terminals branch from a certain common terminal. Viewed from this common terminal, the feeding terminals are structured with the same physical conditions, and the polarization planes, electrical powers and phases of the electromagnetic waves radiated from the respective feeding terminals of the striplines 47 are the same. The common terminal receives electricity fed through coaxial wiring through a feeding port of the feeding port plate 46.

At the electromagnetic wave reflection plate 45, non-penetrating cylindrical cavities 48 with positions and diameters the same as all the circular waveguides 410 of the circular waveguide plate 41 are machined into the electromagnetic wave reflection plate for reflecting the electromagnetic waves that radiate downward from the feeding terminals of the striplines 47 back upward. Respective depths of the non-penetrating cylindrical cavities 48 are approximately a quarter of a wavelength in the tubes $\lambda g$. Here, floor faces of the non-penetrating cylindrical cavities 48 must be treated so as to be completely flat and reflect the electromagnetic waves well. The plate 46 is a plate including an antenna feeding port 49, and is electrically connected with other apparatus through the feeding port 49. When a high-frequency signal is fed to this feeding port 49, the common terminal of the striplines 47 at the stripline circuit sheet 44 is structured to receive the high-frequency signal and equally distribute the high-frequency signal to the feeding terminals of all the striplines 47.

FIGS. 32A and 32B are detailed views of the circular waveguide plate 41 of FIGS. 31A and 31B. FIG. 32A is a perspective sectional view of the circular waveguide plate 41 and FIG. 32B is a sectional view seen in front elevation. The circular waveguide plate 41 is a conductor plate with a thickness of several mm, in which cylindrical holes are machined in a square region at a central portion with diameters determined in consideration of the electromagnetic wave propagation mode TE11, to structure the openings 42 of the array elements. The openings 42 of the array elements are cylindrical through-holes, and are orthogonal to the circular waveguide plate 41.

Here, a reason for selecting circular waveguides is that it is possible to form the tubular holes with high machining accuracy and with ease by drilling or the like. However, in the propagation mode TE11, an electric field distribution at the upper portion openings of the array elements is by no means an optimal electric field distribution.

The conventional circular waveguide array antenna shown in FIGS. 31A and 31B is, in a sense, an array in which the circular waveguide antenna shown in FIGS. 30A and 30B is structured with a compact form. When machining so as to form the circular waveguide antennas which will be array elements, it is possible to realize high arrangement accuracy of the array elements, high dimensional accuracy and easy machining, all at the same time.

In order to form the circular waveguide array antenna as a circular waveguide antenna for linearly polarized waves or a circular waveguide antenna for circularly polarized waves, the array elements structuring the antenna are set as circular waveguide antennas for linearly polarized waves or circular waveguide antennas for circularly polarized waves (see, for example, Non-patent References 2 and 3).

Patent Reference 1: Japanese Patent Application Laid-open (JP-A) No. 2000-353916 (paragraphs 0014 to 0019 and FIG. 1)

Non-patent Reference 1: Seiji Nishi, Yozo Shoji and Hiroyo Ogawa: "Millimeter-Wave Ad-Hoc Wireless Access System II: (7) 70 GHz Circular Polarization Antenna", Technical Digest, 5th Topical Symposium on Millimeter Waves TSMMW2003, pp. 65-68, March 2003, Kanagawa, Japan.

Non-patent Reference 2: Seiji Nishi, Kiyoshi Hamaguti, Toshiaki Matui, Hiroyo Ogawa: "A Wireless Video Home-Link Using 60 GMHz Band: A Proposal Of Antenna Structure", Proc., 30th European Microwave Conference, Volume 1, pp. 305-308, October 2000, Paris, France.

Non-patent Reference 3: Seiji Nishi, Kiyoshi Hamaguti, Toshiaki Matui, Hiroyo Ogawa: "Development of Millimeter-Wave Video Transmission System II: Antenna Development", Technical Digest, 3rd Topical Symposium on Millimeter Waves TSMMW2001, pp. 207-210, March 2001, Kanagawa, Japan There is no reason not to consider Non-patent Reference 1 or the conventional circular waveguide antenna shown in FIGS. 30A and 30B as, in a sense, conical horn antennas. That is, a circular waveguide antenna is a conical horn antenna with an opening angle of 0°. At the circular waveguide of such a conventional circular waveguide antenna, an opening 20 for radiating electromagnetic waves is ordinarily employed without alteration from a cut-off circular waveguide. Thus, there has been a problem in that it is not in any way possible to obtain optimal radiation characteristics.

Moreover, the conventional circular waveguide antenna illustrated in Non-patent Reference 1 has had a problem in that reflection loss characteristics of the antenna are not good and radiation gain is low.

Furthermore, the conventional array antenna illustrated in Patent Reference 1 is an antenna in which a number of electromagnetic horn elements is reduced and radiation characteristics are improved, but has had a problem in that the forms of the electromagnetic horn elements are large and it is not possible to make them small. Furthermore, there has been a problem in that forms of the electromagnetic horn elements that would maximize radiation gain have not been clear.

Moreover, the conventional circular waveguide array antennas illustrated in Non-patent References 2 and 3 have had a problem in that reflection loss characteristics of the antennas are not good and radiation gains are low.

Further, in high-frequency circuits, characteristics of devices may deteriorate due to adverse effects of reflected waves, and operations may cease. If reflected waves are to be blocked, it is necessary to provide matching circuits and cutoff filters or the like at the feeding terminals. If, for example, a matching circuit and a filter, or an isolator or the like, are provided prior to a feeding port, then it is necessary to adjust the impedance of the antenna. Consequently, there has been a problem in that antennas are larger and costs are higher.

Accordingly, provision of a low-cost, compact circular waveguide array antenna which can enable both ameliorated antenna reflection loss characteristics and improvements in radiation characteristics, particularly radiation gain, has been desired.

SUMMARY OF THE INVENTION

A circular waveguide antenna of the present invention is a circular waveguide antenna including: a feeding portion at one end of a circular waveguide, the feeding portion feeding electromagnetic waves; and a radiation aperture at an opposite end of the circular waveguide, the radiation aperture radiating the electromagnetic waves, wherein the circular waveguide includes a conical horn, with a diameter of a feeding side aperture at the feeding portion end being a, a diameter of the radiation aperture being d, which is larger than the diameter a of the feeding side aperture, and an opening angle being $2\alpha$, and if a wavelength of a central frequency of an employed frequency band is $\lambda$, then a value $\alpha$ (below referred to as an opening angle $\alpha$ value), which is half of the opening angle $2\alpha$, the diameter d of the radiation aperture and the value of the wavelength $\lambda$ of the central frequency of the employed frequency band are at least one of set in predetermined ranges and set such that $\alpha$, d and $\lambda$ satisfy a predetermined relationship with one another.

In particular, in the circular waveguide antenna of the present invention, the opening angle $\alpha$ value is between $0.8\times \mathrm{Arcsin}(0.1349114/(d/\lambda))$ and $1.2\times \mathrm{Arcsin}(0.1349114/(d/\lambda))$ In the present invention, the circular waveguide is a conical horn with the diameter of the feeding side aperture at the feeding portion side being a, the diameter of the radiation aperture being d which is larger than the diameter of the feeding side aperture a, and the opening angle being $2\alpha$, When the wavelength of the central frequency of the employed frequency range is $\lambda$, the value of the opening angle $\alpha$ is between $0.8\times \mathrm{Arcsin}(0.1349114/(d/\lambda))$ and $1.2\times \mathrm{Arcsin}(0.1349114/(d/\lambda))$. Thus, antenna reflection loss characteristics are ameliorated, and radiation characteristics, particularly radiation gain, can be improved, and the circular waveguide can be formed in a compact form with a low price.

BRIEF DESCRIPTION OF THE DRAWINGS

Preferred exemplary embodiments of the present invention will be described in detail based on the following figs., wherein.

DETAILED DESCRIPTION OF THE INVENTION

First Embodiment

First, basic structure of a circular waveguide antenna relating to a first embodiment of the present invention will be described. A difference of circular waveguide antennas of the present invention from conventional circular waveguide antennas is the shape of an opening which radiates electromagnetic waves.

That is, while openings of conventional circular waveguide antennas are cut-off circular waveguides, an opening of a circular waveguide antenna of this invention is provided with a predetermined opening angle in accordance with an employed frequency, radiation gain is made as large as possible, and reflection losses at a feeding portion are minimized.

Figure 1A:
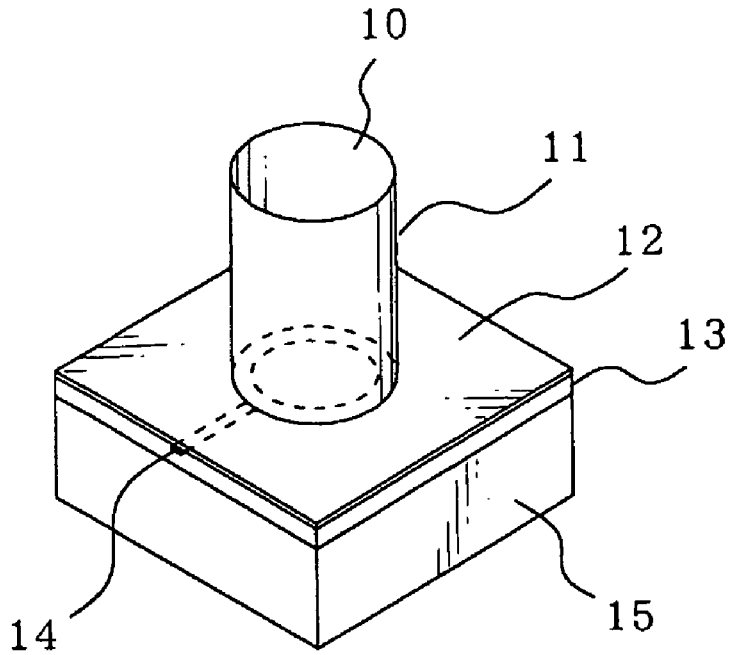
FIG. 1A is a structural view of a circular waveguide antenna which illustrates a first embodiment of the present invention.
Figure 1B:
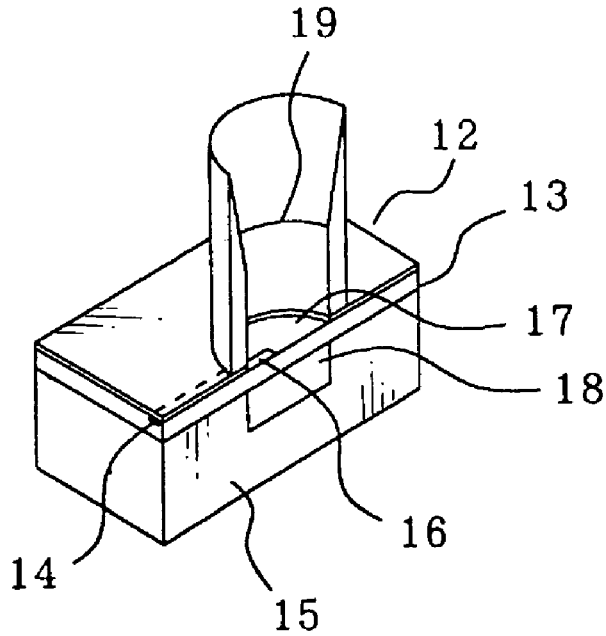
FIG. 1B is a structural view of a circular waveguide antenna which illustrates a first embodiment of the present invention.
Figure 2:
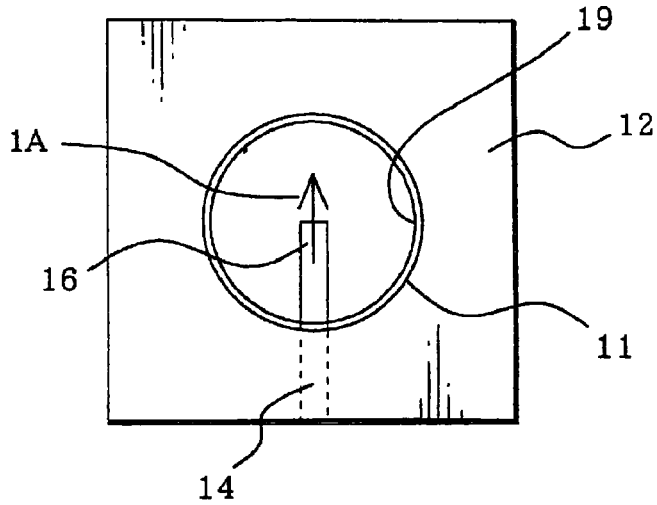
FIG. 2 is a plan view of the circular waveguide antenna which illustrates the first embodiment of the present invention.

FIGS. 1A and 1B are structural views of a circular waveguide antenna which illustrates the first embodiment of the present invention. FIG. 1A is a perspective view of a horn-type circular waveguide antenna, and FIG. 1B is a side sectional view. FIG. 2 is a plan view of the circular waveguide antenna.

Figure 30A:
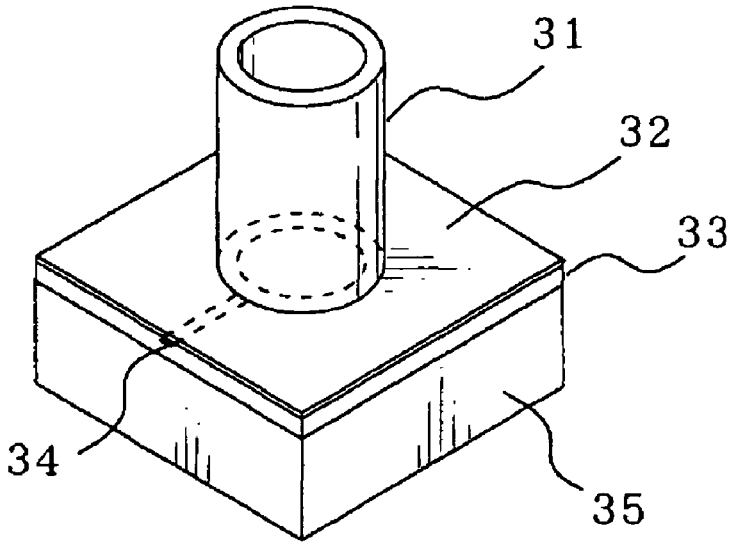
FIG. 30A PRIOR ART
FIG. 30A is a structural view of a previous circular waveguide antenna.
Figure 30B:
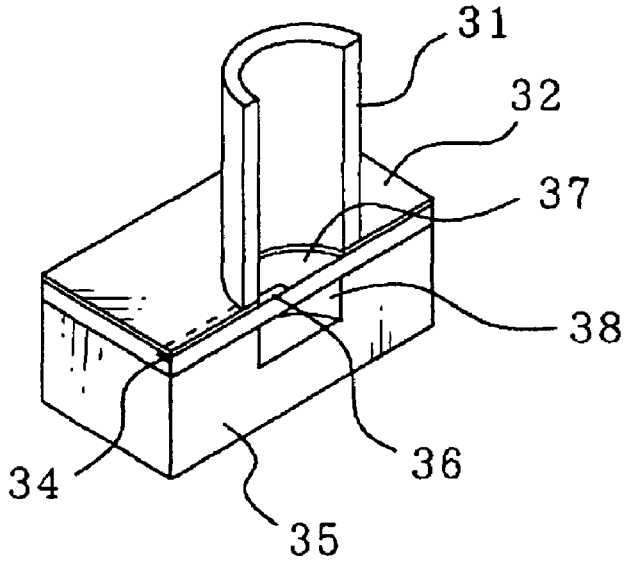
FIG. 30B PRIOR ART
FIG. 30B is a structural view of a previous circular waveguide antenna.

Structurally, this is similar to the circular waveguide antenna shown in FIGS. 30A and 30B, but differs in that an aperture of the antenna is conical rather than being circular.

In FIGS. 1A and 1B, a circular waveguide antenna includes a feeding portion 17, which feeds electromagnetic waves to one end of a conical horn 11, and the circular waveguide antenna is provided with a radiation aperture 10, which radiates the electromagnetic waves, at the opposite end of the conical horn 11. The conical horn 11 is cut to a predetermined length, and is electrically connected to and earthed at a dielectric sheet 12, which is provided with a conductive film. The conductive film coinciding with a lower portion opening of the conical horn 11 has been removed. A dielectric sheet 13, with the dielectric sheet 12, sandwiches a stripline 14, which is a propagation path.

The stripline 14 has the role of propagating high-frequency signals, and extends to the middle of the conical horn 11. A dielectric exposure portion of the dielectric sheet 12 covers a stripline distal end 16 of the stripline 14, to structure the feeding portion 17.

In FIG. 2, 1A is an arrow showing the direction of an electric field, and is in the same direction as the stripline distal end 16 which is exposed at the circular waveguide.

A conductor 15 is a base of the antenna and incorporates a cylindrical cavity 18 for electromagnetic wave reflection, which is provided such that electromagnetic waves which radiate from the stripline 14 radiate from the radiation aperture 10 simultaneously. Inside the conical horn 11, there is a boundary line 19 between a circular waveguide and a conical horn. The circular waveguide is formed after the conical horn has been machined.

Figure 4:
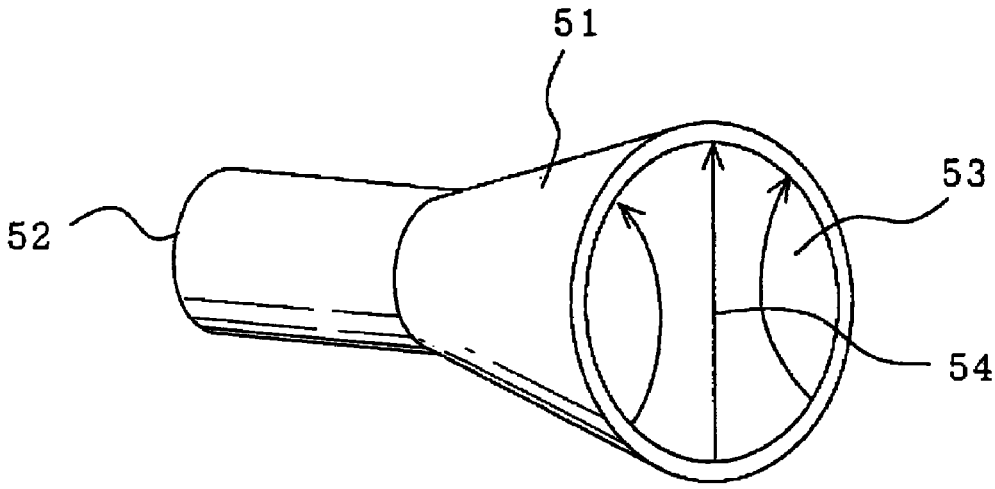
FIG. 4 is a perspective view of a horn antenna.
Figure 5:
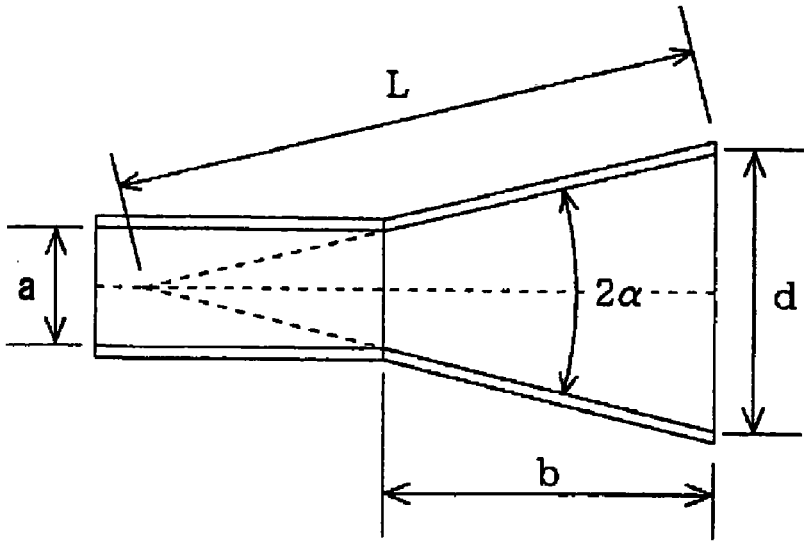
FIG. 5 is a side sectional view of the horn antenna.

Now, this horn-type circular waveguide antenna has characteristics basically the same as an ordinary horn antenna, which is shown in FIGS. 4 and 5. Therefore, results of investigating conditions for maximizing radiation gain and suppressing reflection losses to a minimum for this horn antenna will be described.

FIG. 4 is a perspective view of the horn antenna and FIG. 5 is a side sectional view of the horn antenna.

In FIGS. 4 and 5, a circular waveguide 52, which is a feeding opening, is connected with a conical horn antenna main body 51, 53 is an aperture, and 54 represents an electric field distribution in the TE11 mode.

A diameter of the aperture 53 is d, a diameter of the circular waveguide 52 is a, a flare is L, a distance from the aperture 53 to a proximal end of the circular waveguide of the feeding opening is b, and an opening angle is 2α.

First, radiation gain of the horn antenna is represented by equation (1).

$$G=20\log(\pi d/\lambda)+\eta(\mathrm{dB}) \quad (1)$$

λ is the wavelength of a central frequency of a frequency range that is employed, and η is an aperture efficiency of the horn antenna, which is ordinarily shown with decibels as the unit.

Figure 6:
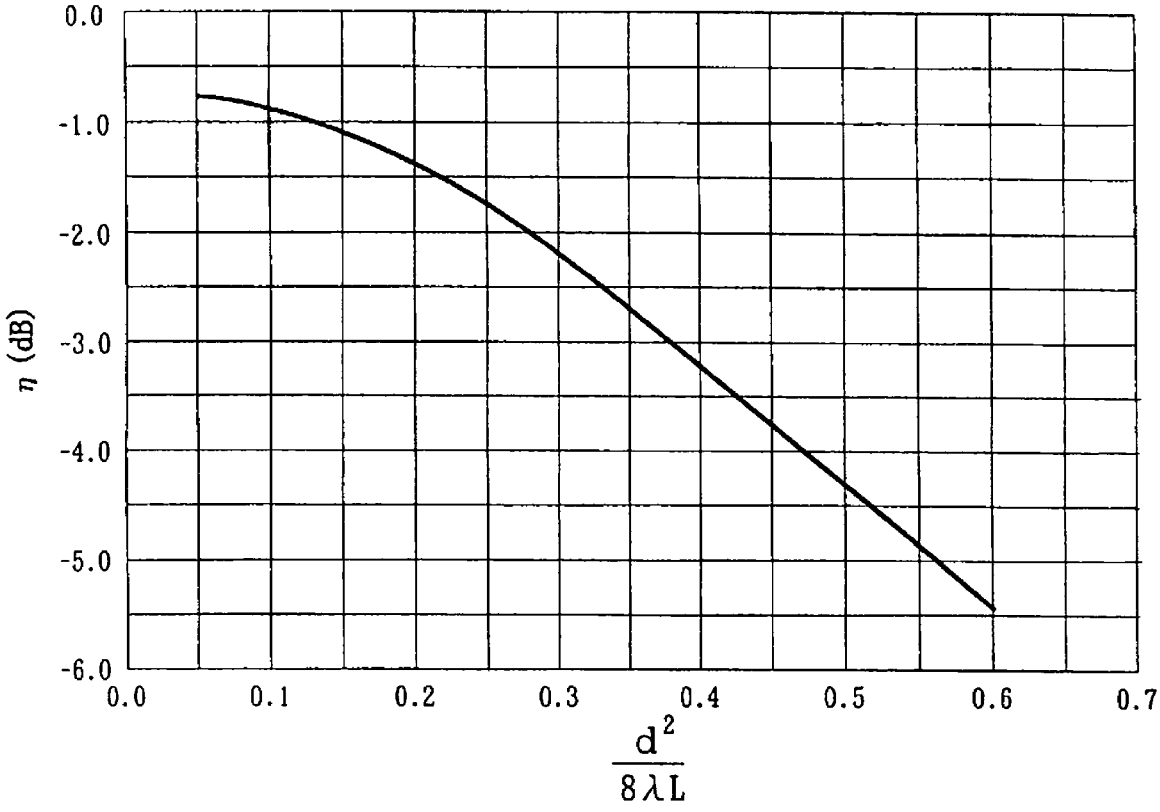
FIG. 6 is a characteristic of aperture efficiency $\eta$ of the horn antenna.
Figure 7A:
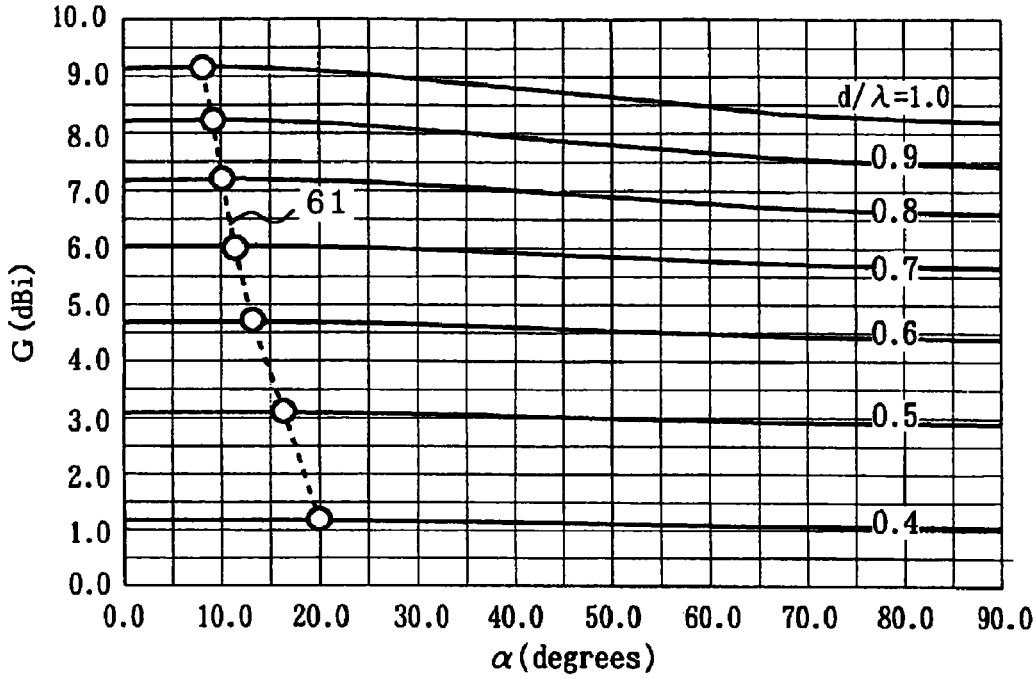
FIG. 7A is radiation gain characteristics of the horn antenna.
Figure 7B:
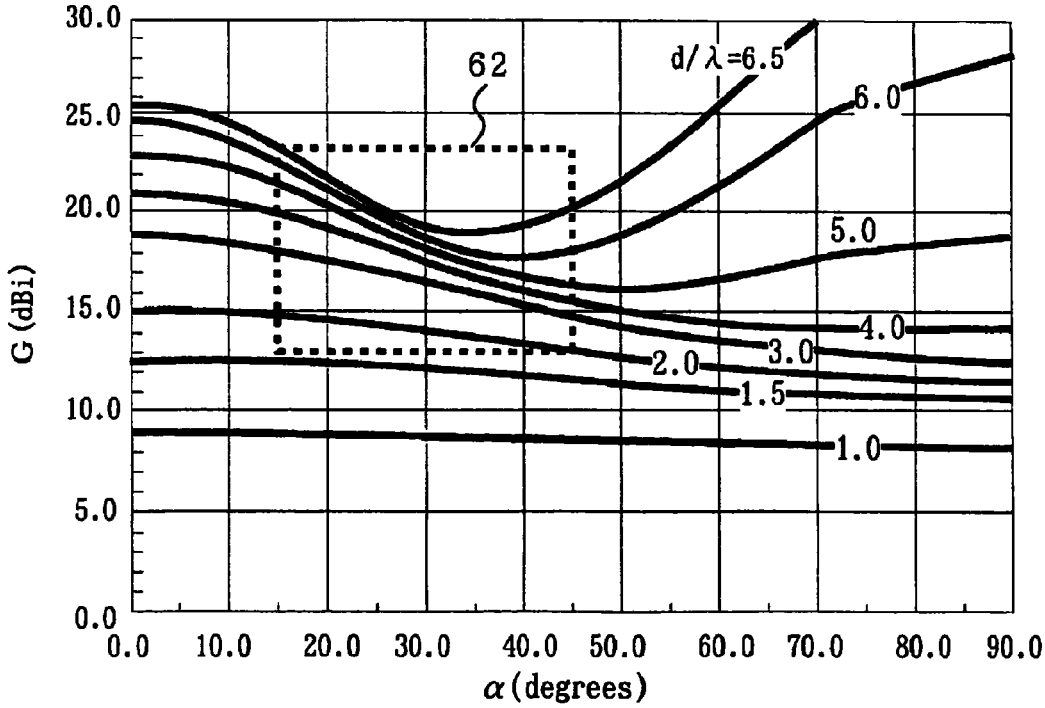
FIG. 7B is radiation gain characteristics of the horn antenna.

A characteristic of the aperture efficiency η of the horn antenna is shown in FIG. 6. If the radiation gain G is calculated using this, radiation gain characteristics for an ordinary horn antenna as shown in FIGS. 7A and 7B are obtained. For these characteristics, relationships between the radiation gain G and α, which is half the opening angle of the horn antenna, are calculated, with d/λ as a variable parameter, and are graphed.

FIGS. 7A and 7B are radiation gain characteristics, which are shown divided into cases in which d/λ is less than 1 and cases in which d/λ is greater than 1.

When d/λ is 1.0, as shown in FIG. 7A, the radiation gain G is large, and as d/λ becomes smaller than 1.0, the radiation gain G becomes smaller, and there are respective values of α at which G is maximized for corresponding values of d/λ.

In FIG. 7A, the values at which G is maximized for corresponding values of d/λ are shown by a broken line, line 61, which is a characteristic curve of maximum values of G. The value of α is a basic factor of design of the horn antenna.

As d/λ becomes larger, the radiation gain G rises. For example, when d/λ=1, the radiation gain G of the array elements is at a maximum, being 9.171486 dB, if α, half the opening angle 2α of the horn antenna, is 7.7530°.

It is thought that it is most preferable if α is 7.7530°, that it is preferable if α is approximately 7.7530°, and that it is satisfactory if α is that value ±2°. Thus, the opening angle α has a preferable range from 7.7530°−2° to 77.7530°+2°.

When G is at a maximum, reflection losses are at a minimum. That is, power of the electromagnetic waves that are fed should be maximally radiated from the aperture. On the other hand, as shown in FIG. 7A, as a becomes smaller or larger than the value of α at which G is maximized, the radiation gain G proceeds to fall from the maximum value.

Meanwhile, as shown in FIG. 7B, with α in a range from about 15° to 45° and d/λ in a range from about 2.0 to 6.0, it is clear that radiation gain values cluster within a region of about 18±5.0 dBi (box 62), and there are variations in gain in the vicinity of about 27°.

It is also understood that when d/λ is around 1 or less, as d/λ becomes smaller, the radiation gain substantially stabilizes and is not significantly affected by α.

Figure 8A:
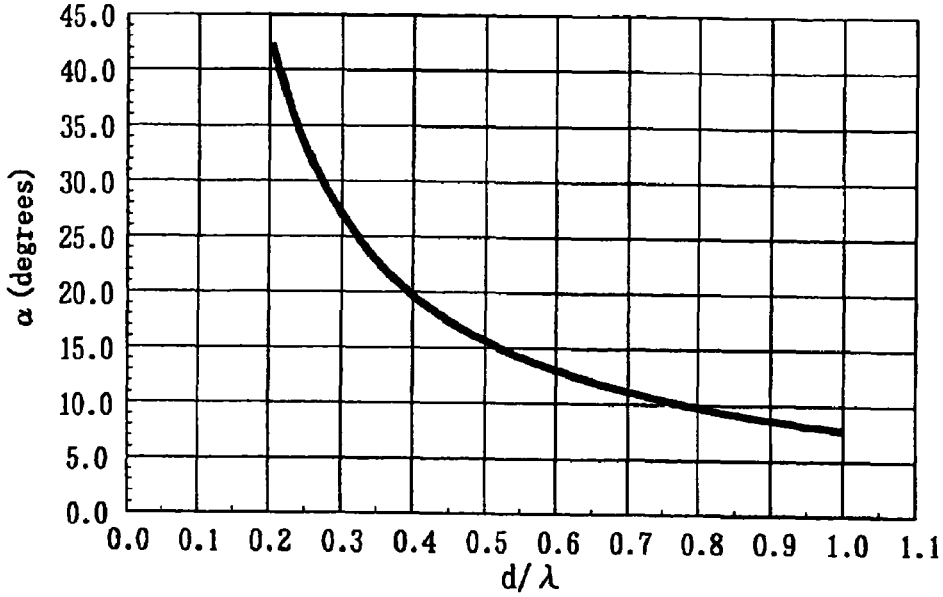
FIG. 8A is maximum radiation gain characteristics.

FIG. 8A shows a relationship between d/λ and α such that G is always maximized. FIG. 8A corresponds to a plot of the values of α for which the radiation gain G is maximized in FIG. 7A for respective values of d/λ, which is calculated and plotted as a graph.

Thus, it is seen that, if either d/λ or α is specified, dimensions of the horn antenna such that G is maximized are uniquely determined.

From these calculation results, the relationship between d/λ and α that is shown in FIG. 8A is represented by equation (2).

$$\alpha=\mathrm{Arcsin}(0.1349114/(d/\lambda)) \quad (2)$$

As is seen from equation 2, in order for there to be a value of α, it is necessary for the diameter of the aperture of the horn antenna to satisfy a condition as shown in equation (3).

$$d>0.1349114\lambda \quad (3)$$

Figure 8B:
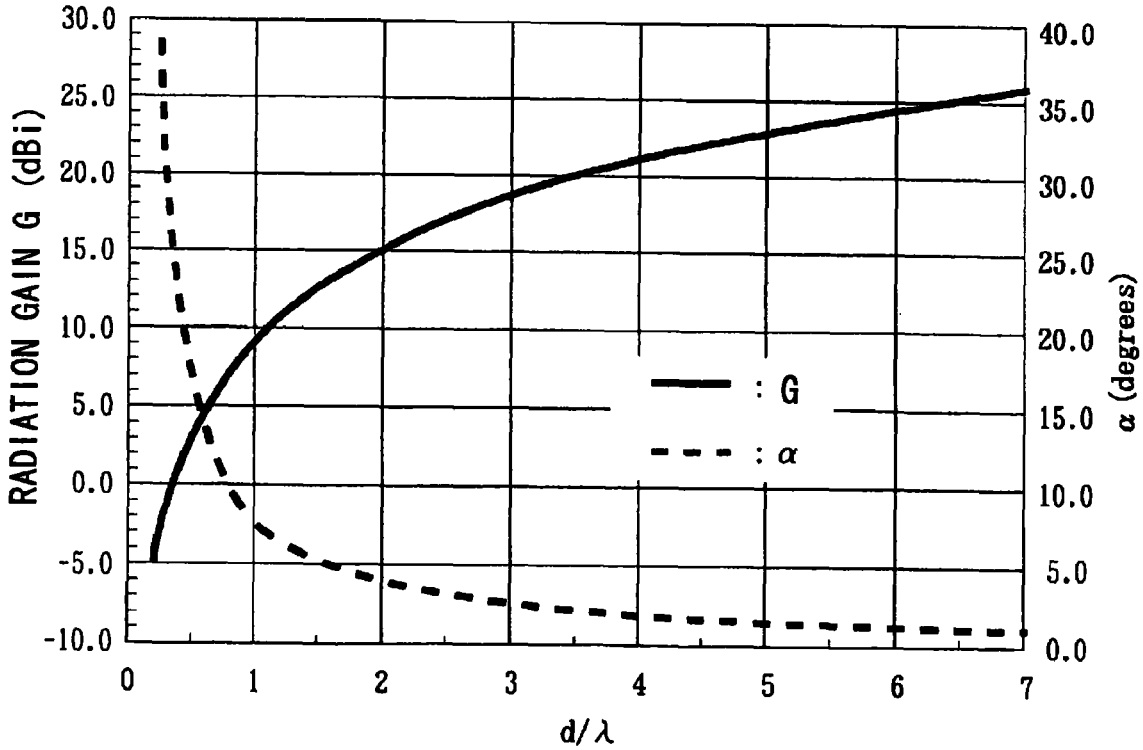
FIG. 8B is maximum radiation gain characteristics.

FIG. 8B is a characteristic showing what level of radiation gain is obtained given any value of α. As is clear from this characteristic, when the value of d/λ is greater than about 3, it is seen that the value of α changes very little and only the gain increases.

In the present invention, the value α, which is half of the opening angle, is represented by equation (2) such that the radiation gain of the horn is at a maximum. While a value indicated by equation (2) is most preferable, it is considered that this value ±20% will be satisfactory, and the opening angle α is set in a preferable range between 0.8×Arcsin (0.1349114/(d/λ)) and 1.2×Arcsin(0.1349114/(d/λ)).

There is no reason not to consider the conventional circular waveguide antenna shown in FIGS. 30A and 30B as, in a sense, a horn antenna, the circular waveguide antenna being a horn antenna with an opening angle of 0°. If the opening angle is 0°, the radiation gain G is not at a maximum according to equation (2), and reflection loss characteristics and radiation characteristics of the circular waveguide antenna are not optimal.

From the above results, for the radiation aperture 10 of the conical horn 11 of the circular waveguide antenna shown in FIG. 1, with the wavelength λ of the central frequency and the diameter a of the conical horn 11 being established and half the opening angle being α, the radiation aperture 10 of the conical horn 11 is formed such that the diameter d and the flare L are set so as to satisfy equation (2).

Further, feeding of the horn-type circular waveguide antenna relating to the first embodiment of the present invention is at the stripline distal end 16 of the linear stripline 14, and the direction of a radiation electric field is in the same direction as the stripline 14. Therefore, the circular waveguide antenna of the first embodiment of the present invention is a circular waveguide antenna for linearly polarized waves with the polarization being in the same direction as the stripline 14.

Figure 3:
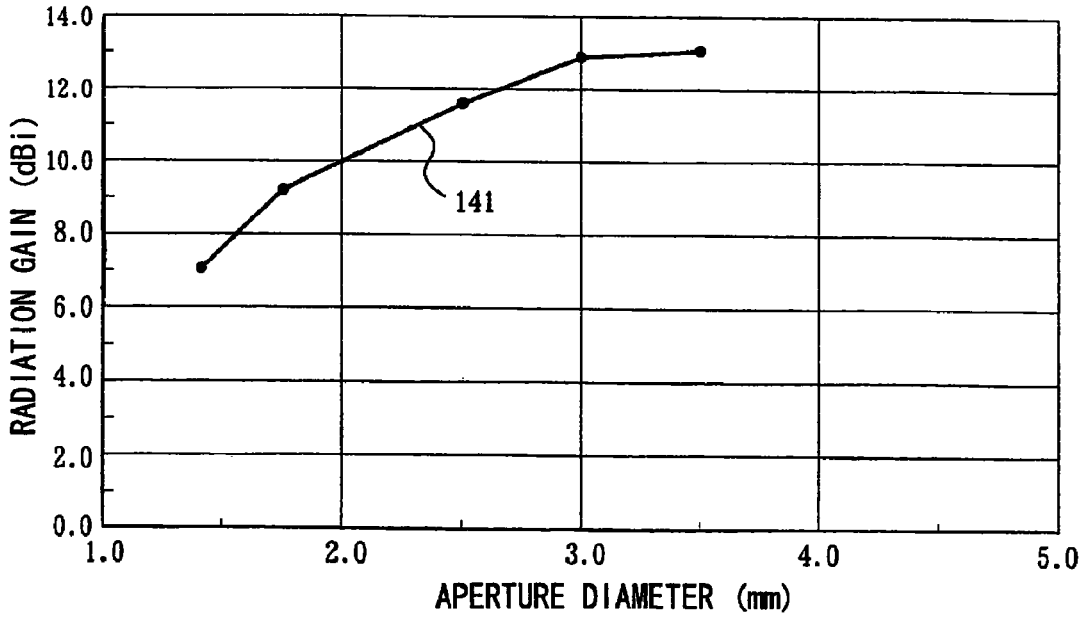
FIG. 3 is a gain characteristic from test results of the circular waveguide antenna which illustrates the first embodiment of the present invention.

Next, operation of the circular waveguide antenna which illustrates the first embodiment of the present invention will be described using FIGS. 1A to 3. FIG. 3 is a gain characteristic of the horn-type circular waveguide antenna tested at 69 GHz.

Here, in order to verify the relationship between radius of the radiation aperture 10 of the horn-type circular waveguide antenna and radiation gain, results of testing the horn-type circular waveguide antenna with a central frequency of 69 GHz will be described.

Radiation gain was investigated with the radius of the radiation aperture 10 broadening from 1.4 mm to 3.5 mm. As shown in FIG. 3, results thereof are that the radiation gain varied from 6.5 dBi to 12.5 dBi (line 141), the radiation gain rising by about 6.0 dBi.

Thus, when the radius of the radiation aperture 10 was widened from 1.4 mm to 3.5 mm, the radiation gain reached a substantial maximum value, and results close to values expected from calculating the radiation gain G of the horn antenna with equation (1) were obtained.

In the circular waveguide antenna, when a predetermined high-frequency signal is inputted through the stripline 14, the signal propagates to the stripline distal end 16, and feeds into the conical horn 11. Because the exposed length of the stripline distal end 16 and the diameters and shape of the conical horn 11 and the like are optimized, electric power supplied to the stripline 14 is almost all radiated from the radiation aperture 10 as linearly polarized waves without reflection.

As described above, when the conical horn is formed with the diameter of the feeding side aperture at the feeding portion side of the conical horn 11 being a, the diameter of the radiation aperture 10 being d, which is larger than the diameter a of the feeding side aperture, and the opening angle being $2\alpha$, and the wavelength of the central frequency of an employed frequency band is $\lambda$, if the value of the opening angle $\alpha$ is set to about $\mathrm{Arcsin}(0.1349114/(d/\lambda))$, the aperture of a conventional circular waveguide antenna being widened to form a conical shape, the following effects are present.

(1) The radiation gain of the circular waveguide antenna can be maximized, and reflection losses can be minimized.

(2) As shown in FIG. 3, from results of testing a circular waveguide antenna at a central frequency of 69.0 GHz, radiation gain was raised about 6.0 dBi by widening the aperture.

(3) As described above, increasing the radiation gain means radiating supplied electromagnetic waves from the radiation aperture 10 efficiently. Thus, electric power that is reflected during propagation within the antenna and returns back to the stripline 14 is reduced. That is, a reflection loss characteristic of the antenna, known as an S11 parameter, is improved relative to the reflection loss characteristic of a conventional circular waveguide antenna, and an improvement of about 10 dB is possible with the present embodiment.

(4) With a high-frequency circuit, if characteristics of the apparatus deteriorate or the apparatus ceases to operate due to adverse effects of reflected waves, and it is necessary to block reflected waves, it is necessary to provide a matching circuit at the feeding terminal and/or provide a cutoff filter. For example, in the case of the present invention, it would be necessary to dispose a matching circuit and a filter, or an isolator or the like, prior to a feeding port. However, if the S11 parameter of the antenna is improved as described for effect (3), a matching circuit and filter or isolator are no longer required, and such devices are unnecessary. Therefore, the circular waveguide antenna can enable a reduction in prices.

(5) Because, as described for effect (4), provision of a matching circuit and filter or isolator at the feeding port of the antenna is no longer required, space for disposing such devices is not required. Therefore, the circular waveguide antenna can be reduced in size.

Thus, it is possible to achieve an increase in functionality, a reduction in price, and a reduction in size of the circular waveguide antenna relating to the first embodiment of the present invention.

Further, although an application of the circular waveguide of the present embodiment is linearly polarized waves, applications of this antenna can include usage for communications with millimeter waves and sub-millimeter waves, and employment as an antenna for contemporary ETC (Electric Toll Collection), in-building wireless LANs and the like is possible.

Further yet, these characteristics are produced with the circular waveguide antenna for linearly polarized waves, and the circular waveguide antenna can be utilized for communications with a circular waveguide antenna with horizontally polarized waves, vertically polarized waves or linearly polarized waves with a polarization plane in a particular direction.

Second Embodiment

In the first embodiment, feeding to the conical horn 11 is through the simple cut-off linear stripline distal end 16, and thus the circular waveguide antenna that is obtained is a circular waveguide antenna for linearly polarized waves.

However, when machining a cut-off stripline in a straight line for feeding, the circular waveguide antenna may be changed from a circular waveguide antenna for linearly polarized waves to a circular waveguide antenna for circularly polarized waves, and a circular waveguide antenna for circularly polarized waves can be obtained with hardly any deterioration in radiation gain, the reflection loss characteristic and the like. The present embodiment illustrates, of antennas for circularly polarized waves, a circular waveguide antenna for left-handed helically polarized waves.

Figure 9:
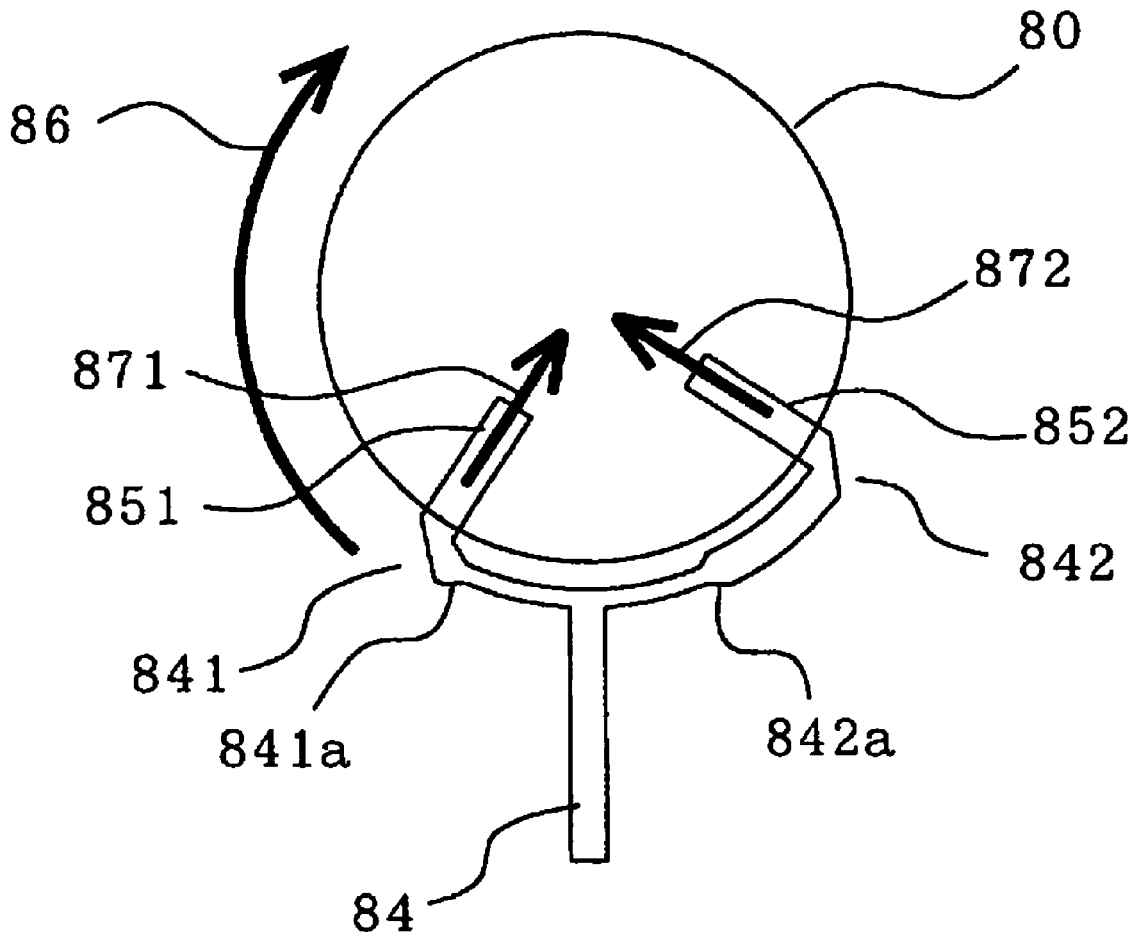
FIG. 9 is a plan view of a circular waveguide antenna which illustrates a second embodiment of the present invention.

FIG. 9 is a plan view showing structure of a circular waveguide antenna which illustrates the second embodiment of the present invention.

The structure is largely the same as in FIG. 1 of the first embodiment of the present invention, so descriptions of such structure will be omitted, and only portions that differ will be described.

In FIG. 9, an aperture 80 of the circular waveguide antenna, which is viewed from directly above, is not a simple cylinder but actually has an opening angle. In order to excitate circularly polarized waves therein, instead of the single cut-off stripline 14 for linearly polarized wave excitation that is shown in FIG. 2 for the first embodiment of the present invention, as shown in FIG. 9, a stripline 84 which connects from an input terminal is divided into two propagation paths 841 and 842. Characteristic impedances of the propagation paths 841 and 842 are basically twice the characteristic impedance of the stripline 84, and linear path widths thereof are narrower by substantially half, which would cause an increase in resistance losses. Therefore, in order to return the linear path widths of the propagation paths 841 and 842 to a linear path width of the stripline 84, characteristic impedance alteration steps 841*a* and 842*a* are provided after a certain length.

The linear path widths of the propagation paths 841 and 842 return to be the same as the linear path width of the stripline 84. Then, in order to adjust radiation field directions, the propagation path 841 is turned through 90° so as to advance toward the center of the circular waveguide, but a propagation path distal end 851 of the propagation path 841 does not reach to the center of the aperture 80 of the circular waveguide antenna. By design with careful consideration of reflections of the signal due to non-continuity of the characteristic impedance of the propagation path through this turn, reflection characteristics are excellent. Similarly, the propagation path 842 at the opposite side also turns through 90° so as to advance toward the center of the circular waveguide but does not reach to the center of the aperture 80 of the circular waveguide antenna. A propagation path distal end 852 of the propagation path 842 is disposed so as to be perpendicular to the propagation path distal end 851 of the propagation path 841, and distances from the respective distal ends to the center of the aperture 80 of the circular waveguide antenna are the same.

Because the circular waveguide antenna of the present embodiment is for left-handed helically polarized waves, respective distances from a point at which the stripline 84 intersects with the impedance alteration branching circuit paths to the propagation path distal ends 851 and 852 are set such that the distance to the propagation path distal end 852 is longer by λg/4. Here, λg is a wavelength of high-frequency signals in propagation paths on a circuit board. Because this is done, strengths of the electric fields radiated from the propagation path distal ends 851 and 852 are the same, but directions thereof are mutually orthogonal, and a phase at the propagation path distal end 852 is delayed by 90°. As a result, the clockwise-turning arrow 86 shown in FIG. 9 is the direction of twisting of the left-handed helically polarized waves, and appears to turn to the right as viewed from directly above. However, if viewed from the rear, looking in the direction in which the electromagnetic waves advance, this is the anti-clockwise direction; that is, it is understood that the radiation field twists to the left.

Thus, with the circular waveguide antenna relating to the present embodiment, it is possible to change from a circular waveguide antenna for linearly polarized waves to a circular waveguide antenna for left-handed helically polarized waves by changing the feeding portion of the linearly polarized wave circular waveguide antenna of the first embodiment.

Next, operation of the left-handed helically polarized wave circular waveguide antenna relating to the second embodiment of the present invention will be described using FIG. 9.

Operation is similar to the linearly polarized wave circular waveguide antenna relating to the first embodiment, and as shown in FIG. 9, only the feeding portion is different.

When, for example, a predetermined high-frequency signal is inputted through the stripline 84, the high-frequency signal propagates in a direction of progress. Upon reaching the branching circuit paths, the high-frequency signal divides into two equal halves in terms of electric power, which are inputted to the propagation paths 841 and 842, respectively, and are propagated further in directions of progress.

The length of the propagation path 841 is λg/4 shorter than the length of the propagation path 842. Therefore, when the divided high-frequency signal reaches the characteristic impedance alteration step 841*a*, the high-frequency signal propagates in the propagation path with the characteristic impedance and propagation path width the same as the stripline 84 and quickly reaches the propagation path distal end 851, and similarly, the divided high-frequency signal at the propagation path 842 side goes through the same sequence and reaches the propagation path distal end 852 with the phase thereof delayed by 90°.

Directions of electric fields 871 and 872 that are radiated from the propagation path distal ends 851 and 852 are directions the same as the respective propagation paths at the distal ends, and cross one another with the electric field 871 being relatively advanced in phase by 90°. Further, with the respective field strengths radiated from the propagation path distal ends 851 and 852 being equal, the electromagnetic waves radiated from the aperture 80 of the circular waveguide antenna are left-handed helically polarized waves.

As described above, the feeding portion 17 is provided with the stripline 84. The stripline 84 is provided with an input propagation path. From the input propagation path, the stripline 84 divides into left and right along an outer side of the aperture at the feeding side of the conical horn 11, as viewed from the side of the conical horn 11 of the aperture 80 which radiates electromagnetic waves, and respective distal ends extend perpendicularly towards the center of the circular waveguide antenna. Thus, the stripline 84 is provided with the propagation path 842 and 852 which is a right propagation path and the propagation path 841 and 851 which is a left propagation path, which extend to predetermined lengths, and circularly polarized electromagnetic waves are radiated. Therefore, while field strengths ordinarily fall by about 70% (about 1.5 dB) when linearly polarized waves are changed to circularly polarized waves, in comparison with conventional cases of circularly polarized waves which are produced by providing an aperture angle at an aperture of a conventional circular waveguide antenna, radiation gain of the antenna can be improved by at least an amount corresponding to the reduction associated with changing to circularly polarized waves (several dB). Thus, an increase in functionality, a reduction in price and a reduction in size of a circular waveguide antenna for circularly polarized waves can be achieved.

Furthermore, the total length of the left propagation path is shorter by ¼ of the wavelength in the stripline λg relative to the total length of the right propagation path, and left-handed helically polarized electromagnetic waves are radiated. Thus, the electromagnetic waves can be used just for communications with another circular waveguide antenna for left-handed helically polarized waves, a feature is provided in that there is less susceptibility to adverse effects from circular waveguide antennas for linearly polarized waves or right-handed helically polarized waves in the same frequency band, and the frequency can be more effectively utilized.

Further still, applications can include application to communications with millimeter waves and sub-millimeter waves, and employment as an antenna for contemporary ETC, in-building wireless LANs and the like is possible.

Third Embodiment

Of circular waveguide antennas, a circular waveguide antenna for left-handed helically polarized light has been illustrated in the second embodiment, and the present embodiment relates to a circular waveguide antenna for right-handed helically polarized waves.

Figure 10:
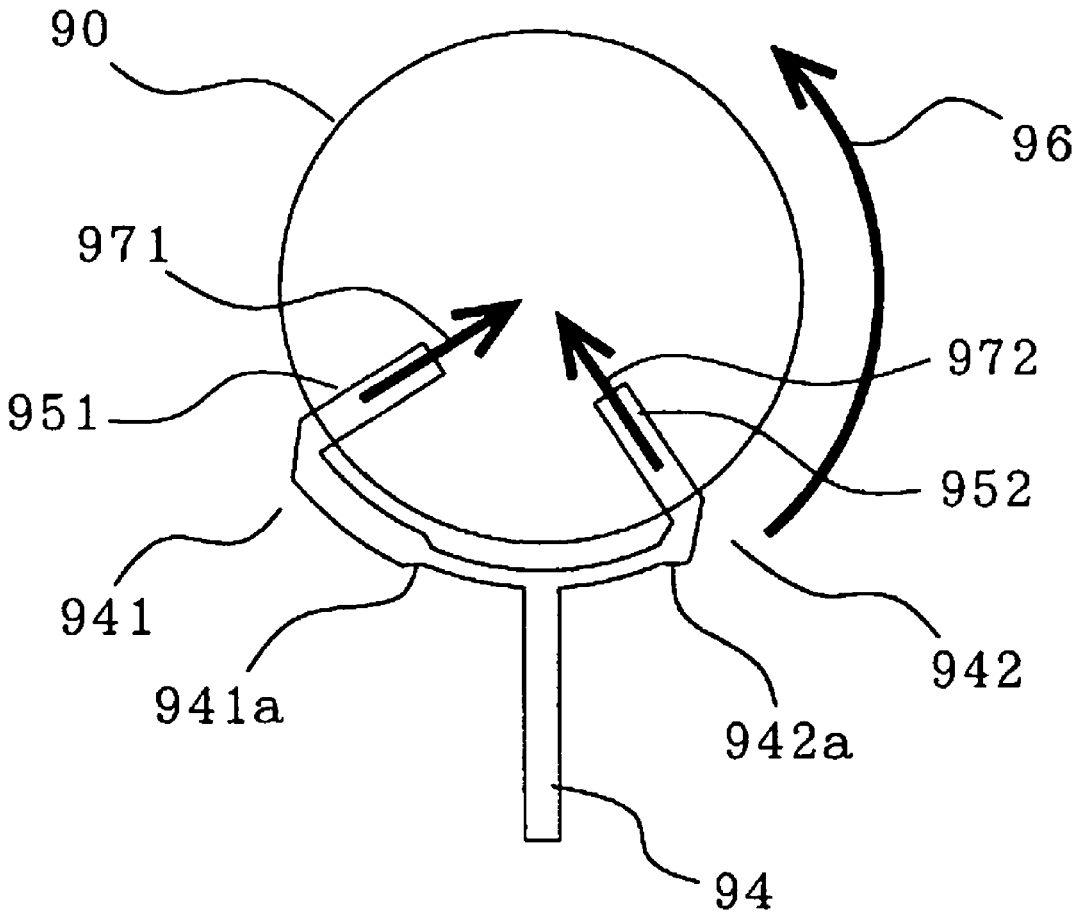
FIG. 10 is a plan view of a circular waveguide antenna which illustrates a third embodiment of the present invention.

FIG. 10 is a plan view showing structure of a circular waveguide antenna which illustrates the third embodiment of the present invention. The present embodiment is very similar in structure to FIG. 9, which shows the second embodiment, and is a structure which adjusts phases of electric fields which are radiated from the propagation path distal ends such that the polarization of the radiated electromagnetic waves is rightward-twisting. Therefore, descriptions of structures will be omitted and only portions that are different will be described.

In FIG. 10, an aperture 90 of the circular waveguide antenna, which is viewed from directly above, is not a simple cylinder but actually has an opening angle. A stripline 94 which connects from an input terminal is divided into two propagation paths 941 and 942. Characteristic impedances of the propagation paths 941 and 942 are basically twice the characteristic impedance of the stripline 94, and linear path widths thereof are narrower by substantially half, which would cause an increase in resistance losses. Therefore, in order to return the linear path widths of the propagation paths 941 and 942 to a linear path width of the stripline 94, characteristic impedance alteration steps 941*a* and 942*a* are provided after a certain length.

The linear path widths of the propagation paths 941 and 942 return to be the same as the linear path width of the stripline 94. Then, in order to adjust radiation field directions, the propagation path 941 is turned through 90° so as to advance toward the center of the aperture 90 of the circular waveguide antenna, but a propagation path distal end 951 of the propagation path 941 does not reach to the center of the aperture 90 of the circular waveguide antenna. By design with careful consideration of reflections of the signal due to non-continuity of the characteristic impedance of the propagation path through this turn, reflection characteristics are excellent. Similarly, the propagation path 942 at the opposite side also turns through 90° so as to advance toward the center of the aperture 90 of the circular waveguide antenna but does not reach to the center of the aperture 90 of the circular waveguide antenna. A propagation path distal end 952 of the propagation path 942 is disposed so as to be perpendicular to the propagation path distal end 951 of the propagation path 941, and distances from the respective distal ends to the center of the aperture 90 of the circular waveguide antenna are the same.

Because the circularly polarized wave circular waveguide antenna relating to the present embodiment is for right-handed helically polarized waves, respective distances from the point at which the stripline 94 intersects with the impedance alteration branching circuit paths to the propagation path distal ends 851 and 852 are set such that, in contrast to the second embodiment, the distance to the propagation path distal end 951 is longer by λg/4. Because this is done, strengths of the electric fields radiated from the propagation path distal ends 951 and 952 are the same, but directions thereof are mutually orthogonal and phase at the propagation path distal end 951 is delayed by 90°. As a result, the anti-clockwise-turning arrow 96 shown in FIG. 10 is the direction of twisting of the right-handed helically polarized waves, and appears to turn to the left as viewed from directly above. However, if viewed from the rear, looking in the direction in which the electromagnetic waves advance, this is the clockwise direction; that is, it is understood that the radiation field twists to the right.

Thus, with the circular waveguide antenna of the present embodiment, it is possible to change from a circular waveguide antenna for left-handed helically polarized waves to a circular waveguide antenna for right-handed helically polarized waves by altering the feeding portion of the second embodiment.

Next, operation of the right-handed helically polarized wave circular waveguide antenna relating to the third embodiment of the present invention will be described using FIG. 10.

Operation is similar to the left-handed helically polarized wave circular waveguide antenna relating to the second embodiment and, as shown in FIG. 10, only the feeding portion is different.

When, for example, a predetermined high-frequency signal is inputted through the stripline 94, the high-frequency signal propagates in a direction of progress. Upon reaching the branching circuit paths, the high-frequency signal divides into two equal halves in terms of electric power, which are inputted to the propagation paths 941 and 942, respectively, and are propagated further in directions of progress.

Because the length of the propagation path 942 is λg/4 shorter than the length of the propagation path 941, when the divided high-frequency signal reaches the characteristic impedance alteration step 942*a*, the high-frequency signal propagates in the propagation path with the characteristic impedance and propagation path width the same as the stripline 94, and quickly reaches the propagation path distal end 952. Similarly, the divided high-frequency signal at the propagation path 941 side goes through the same sequence and reaches the propagation path distal end 951 with the phase thereof delayed by 90°.

Directions of electric fields 971 and 972 that are radiated from the propagation path distal ends 951 and 952 are directions the same as the respective propagation paths at the distal ends, and cross one another with the electric field 972 being advanced in phase by 90°.

Further, with the respective field strengths radiated from the distal ends being equal, the electromagnetic waves radiated from the opening of the circular waveguide are right-handed helically polarized waves.

As described above, the total length of the propagation path 942 which is the right propagation path is shorter by ¼ of the wavelength in the stripline λg than the total length of the propagation path 941 which is the left propagation path, and right-handed helically polarized electromagnetic waves are radiated. Therefore, although field strengths ordinarily fall by about 70% (about 1.5 dB) when linearly polarized waves are changed to circularly polarized waves, in comparison with conventional cases of circularly polarized waves being produced by providing an aperture angle at an aperture of a conventional circular waveguide antenna, radiation gain of the antenna can be improved by at least an amount corresponding to the reduction associated with changing to circularly polarized waves (several dB). Thus, an increase in functionality, a reduction in price and a reduction in size of a circularly polarized wave circular waveguide antenna can be achieved.

Further, the electromagnetic waves can be used just for communications with another circular waveguide antenna for right-handed helically polarized waves, a feature is provided in that there is less susceptibility to adverse effects from circular waveguide antennas for linearly polarized waves or left-handed helically polarized waves in the same frequency band, and the frequency can be more effectively utilized.

Applications of the right-handed helically polarized wave circular waveguide antenna can include application to communications with millimeter waves and sub-millimeter waves, and employment as an antenna for contemporary ETC, in-building wireless LANs and the like is possible.

Fourth Embodiment

In the case of the first embodiment, the antenna may be used alone but, if it were necessary to choose, is inclined toward usage in combination with other devices. In contrast, the present embodiment is a refinement of the circular waveguide antenna for linearly polarized waves of the first embodiment which is more easily used independently.

Figure 11:
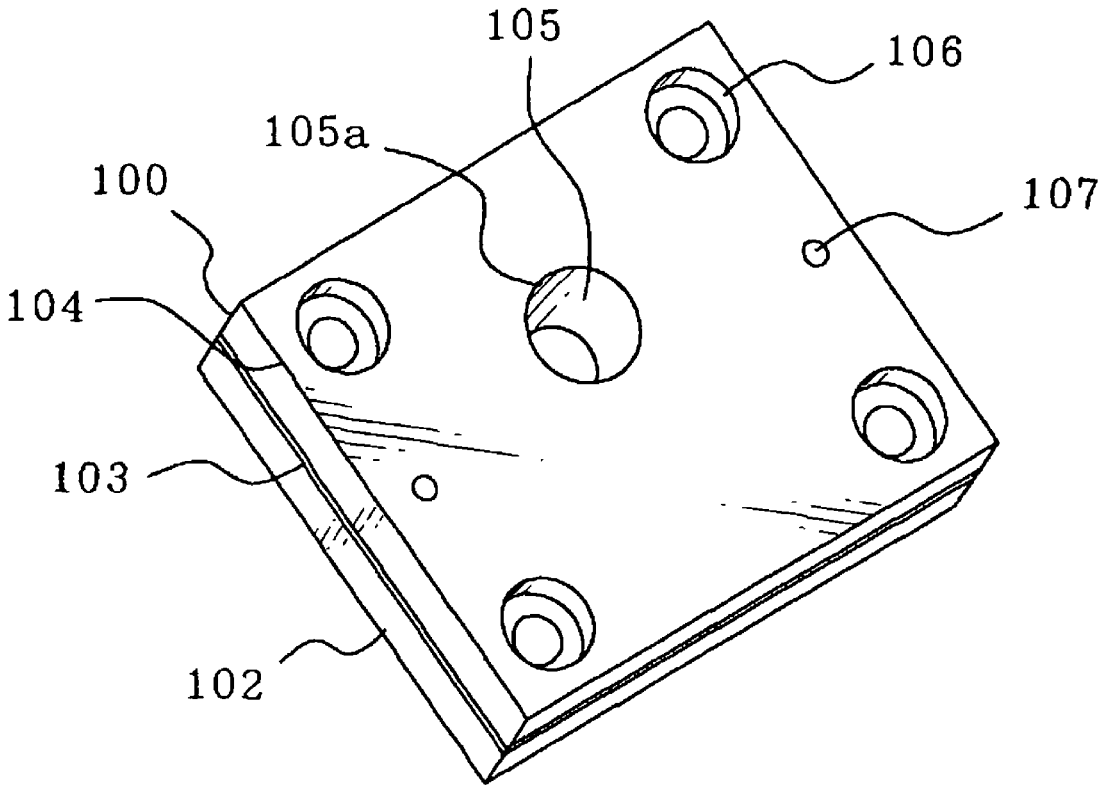
FIG. 11 is an external view of a circular waveguide antenna which illustrates a fourth embodiment of the present invention.

FIG. 11 is an external view of a circular waveguide antenna which illustrates the fourth embodiment of the present invention.

The present embodiment, similarly to the circular waveguide antenna relating to the first embodiment, is a circular waveguide antenna for linearly polarized waves. Thus, a circuit which excitates the linearly polarized waves is the same as in FIG. 2 of the first embodiment when viewed from directly above, being a linear stripline oriented toward the center of a horn-type circular waveguide antenna which radiates electromagnetic waves. However, the present embodiment differs in that rather than the conical horn 11 being formed in the same tubular shape, the horn-type circular waveguide antenna is formed using a conductive plate with a thickness corresponding to the length of the conical horn 11, by machining for cutting the conductinve plate or the like, and is fixed to an antenna base by bolts or the like. That is, the conical horn is machined into the conductive plate which serves as the radiation surface of the antenna, and this can easily be used alone.

In FIG. 11, the circular waveguide antenna is structured by a horn-type circular waveguide plate 100, a stripline circuit sheet 103 and an antenna base 102. The horn-type circular waveguide plate 100 is provided with a radiation plane 104 of the antenna and a conical horn 105 featuring an aperture 105*a*, and acts as an upper portion opening. The stripline circuit sheet 103 feeds electromagnetic waves to the conical horn 105. The antenna base 102 is provided with an electromagnetic wave reflection cavity, and is formed of a conductive plate in which screw holes and the like required for connecting with a feeding portion, an external circuit and the like are formed.

A stripline distal end portion of the stripline circuit sheet 103 is not illustrated, but is the same as in FIG. 2 of the first embodiment.

Furthermore, screw holes 106 and pin holes 107 are formed in the horn-type circular waveguide plate 100. Bolts pass through the screw holes 106 for fixing the horn-type circular waveguide plate 100 to the antenna base 102. The pin holes 107 are used for positioning relative to the antenna base 102. The pin holes 107 penetrate through the horn-type circular waveguide plate 100, and matching pin holes are formed at the same positions of the stripline circuit sheet 103 and the antenna base 102. Positioning is implemented with separate rod-form pins, after which the horn-type circular waveguide plate 100 is fixed to the antenna base 102 with bolts in the screw holes 106.

With this structure, the fourth embodiment of the present invention is a circular waveguide antenna for linearly polarized waves which can easily be used alone.

Now, the structure as described above, when the horn-type circular waveguide plate 100 and antenna base 102 are integrated, acts as the circular waveguide antenna for linearly polarized waves of the first embodiment. Therefore, operations of the circular waveguide antenna for linearly polarized waves of the present embodiment are operations exactly the same as with the circular waveguide antenna for linearly polarized waves of the first embodiment.

For example, when a predetermined high-frequency signal is inputted through the stripline circuit sheet 103, the signal propagates to a radiation terminal (which is not illustrated but corresponds to the stripline distal end 16 of FIG. 1) and is fed to the conical horn 105. Because the exposed length of the radiation terminal and the dimensions and shape of the conical horn 105 are optimized as described for the first embodiment, electric power supplied to the stripline of the stripline circuit sheet 103 is almost all radiated from the aperture 105*a* as linearly polarized waves without reflection.

Because, as described above, the horn-type circular waveguide plate 100 in which the conical horn illustrated by the first embodiment is formed in a conductive plate having a predetermined thickness, the stripline circuit sheet 103 at which the stripline illustrated by the first embodiment is formed to correspond with the conical horn of the horn-type circular waveguide, and the antenna base 102 in which the tubular cavity for electromagnetic wave reflection is formed are provided, in addition to having the same effects as the circular waveguide antenna for linearly polarized waves illustrated by the first embodiment, there is an advantage in that the antenna is structurally robust and can therefore easily be used alone.

Therefore, the circular waveguide antenna of the present embodiment can be mass produced as a stand-alone component and can be provided as a component, and as a result the present embodiment can enable an increase in functionality and a reduction in price of a circular waveguide antenna for linearly polarized waves.

Moreover, because the linearly polarized wave circular waveguide antenna of the present embodiment has the same characteristics as the linearly polarized wave circular waveguide antenna of the first embodiment, in addition to applications being the same as for the first embodiment, the antenna can be used independently.

Fifth Embodiment

The fourth embodiment has illustrated a linearly polarized wave circular waveguide antenna in which a conical horn is machined in the horn-type circular waveguide plate 100 which serves as an antenna radiation surface, the antenna is formed to be easy to use independently, and the stripline circuit sheet 103 excitates linearly polarized waves. In the present embodiment, a circular waveguide antenna for left-handed helically polarized waves is formed in which the stripline circuit sheet 103 is formed as a feeding portion which excitates left-handed helically polarized waves.

In the present embodiment, the exterior is the same as in FIG. 11 of the fourth embodiment, so descriptions of the exterior will not be given.

In this structure, the stripline of the stripline circuit sheet 103 is formed as a feeding portion which excitates left-handed helically polarized waves, which is illustrated in FIG. 9 for the second embodiment.

Operation of the fifth embodiment of the present invention is the same as for the left-handed helically polarized wave circular waveguide antenna of the second embodiment, and will not be described.

With this structure, in addition to having the same effects as the circular waveguide antenna for left-handed helically polarized waves illustrated by the second embodiment, there is an advantage in that the antenna is structurally robust and can therefore easily be used alone.

Therefore, the left-handed helically polarized wave circular waveguide antenna of the present embodiment can be mass produced as a stand-alone component and can be provided as a component, and as a result the present embodiment can enable an increase in functionality and a reduction in price of a circular waveguide antenna for left-handed helically polarized waves.

Moreover, because the left-handed helically polarized wave circular waveguide antenna of the present embodiment has the same characteristics as the left-handed helically polarized wave circular waveguide antenna of the second embodiment, in addition to applications being the same as for the second embodiment, the antenna can be used individually.

Sixth Embodiment

The fifth embodiment has illustrated a left-handed helically polarized wave circular waveguide antenna in which a horn-type circular waveguide is machined in a conductive plate which serves as an antenna radiation surface, the antenna is formed to be easy to use individually, and the stripline circuit sheet 103 excitates left-handed helically polarized waves. In the present embodiment, a circular waveguide antenna for right-handed helically polarized waves is formed in which the stripline circuit sheet 103 is formed as a feeding portion which excitates right-handed helically polarized waves.

In the present embodiment, the exterior is the same as in FIG. 11 of the fourth embodiment, so descriptions of the exterior will not be given.

In this structure, the stripline of the stripline circuit sheet 103 is formed as a feeding portion which excitates right-handed helically polarized waves, which is illustrated in FIG. 10 for the third embodiment.

Operation of the sixth embodiment of the present invention is the same as for the right-handed helically polarized wave circular waveguide antenna of the third embodiment, and will not be described.

With this structure, in addition to having the same effects as the circular waveguide antenna for right-handed helically polarized waves illustrated by the third embodiment, there is an advantage in that the antenna is structurally robust and can therefore easily be used alone.

Therefore, the right-handed helically polarized wave circular waveguide antenna of the present embodiment can be mass produced as a stand-alone component and can be provided as a component, and as a result the present embodiment can enable an increase in functionality and a reduction in price of a circular waveguide antenna for right-handed helically polarized waves.

Moreover, because the right-handed helically polarized wave circular waveguide antenna of the present embodiment has the same characteristics as the right-handed helically polarized wave circular waveguide antenna of the third embodiment, in addition to applications being the same as for the third embodiment, the antenna can be used independently.

Seventh Embodiment

The first to sixth embodiments have illustrated horn-type circular waveguide antennas, and the present and subsequent embodiments will illustrate embodiments of array antennas in which the above-described horn-type circular waveguide antennas are plurally arrayed as array elements.

Figure 12A:
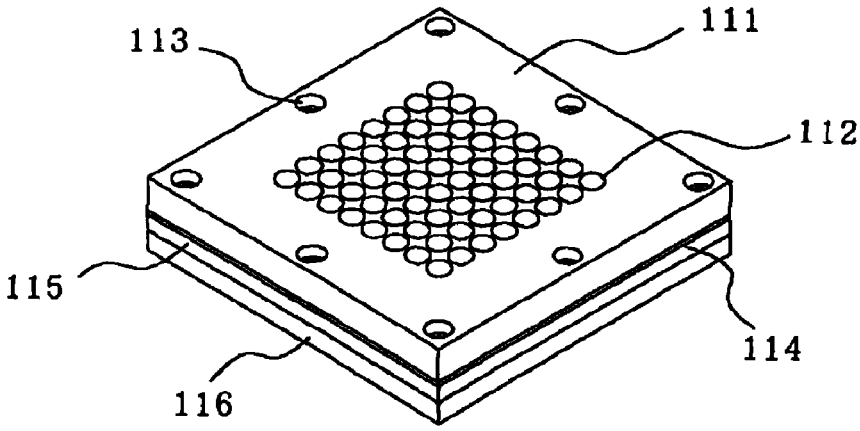
FIG. 12A is a structural view of a circular waveguide array antenna which illustrates a seventh embodiment of the present invention.
Figure 12B:
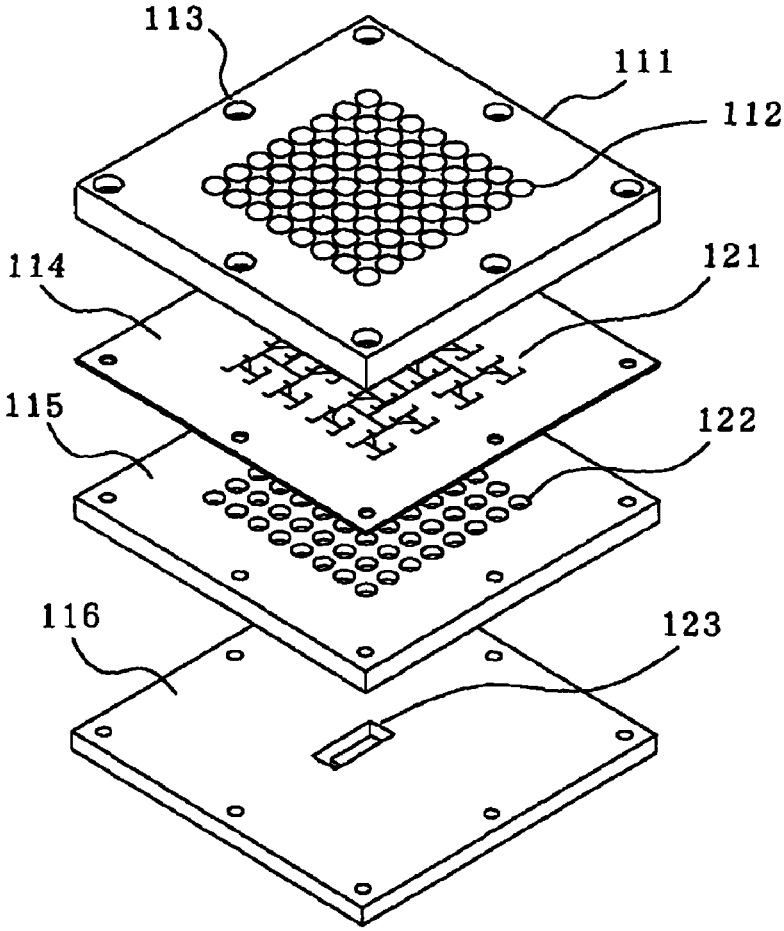
FIG. 12B is a structural view of a circular waveguide array antenna which illustrates a seventh embodiment of the present invention.
Figure 13A:
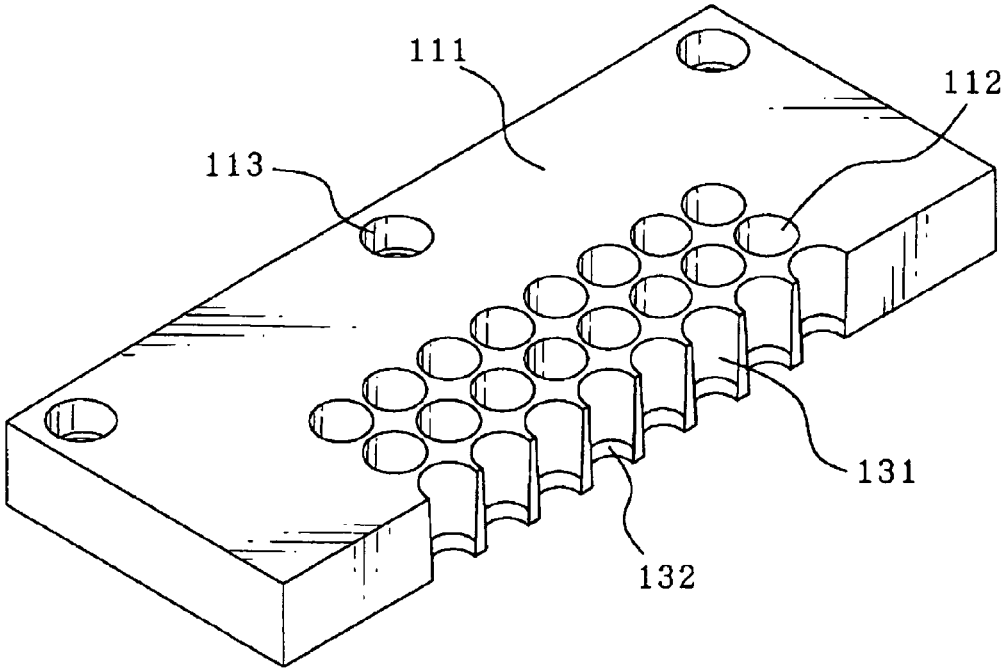
FIG. 13A is a structural view of a horn-type circular waveguide plate of the circular waveguide array antenna which illustrates the seventh embodiment of the present invention.
Figure 13B:
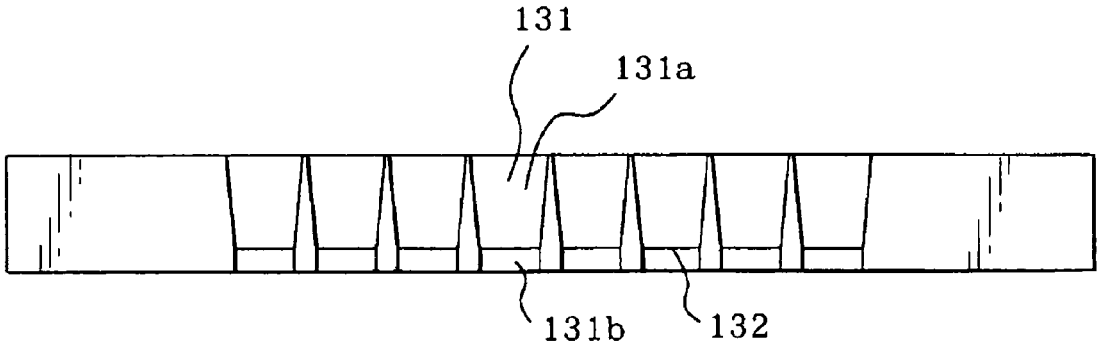
FIG. 13B is a structural view of a horn-type circular waveguide plate of the circular waveguide array antenna which illustrates the seventh embodiment of the present invention.

FIGS. 12A and 12B are structural views of a circular waveguide array antenna which illustrates a seventh embodiment. FIG. 12A is a perspective view and FIG. 12B is an exploded perspective view of the circular waveguide array antenna. FIGS. 13A and 13B are structural views of a plate of a horn-type circular waveguide array antenna. FIG. 13A is a perspective sectional view of the horn-type circular waveguide plate and FIG. 13B is a sectional view seen in front elevation.

A radiation plane of the antenna is a horn-type circular waveguide plate 111, in which horn-type circular waveguides which act as upper portion openings of the array element are machined with equal spacings over a square region. Array element openings 112 and screw holes 113, which are required when assembling the antenna and when fixing the antenna to other apparatus, are formed in the horn-type circular waveguide plate 111.

In the horn-type circular waveguide plate 111, a conductive plate with a thickness of several mm, within the square region at a middle portion, cylindrical through-holes are machined, and apertures of these through-holes are formed with conical shapes. Thus the array element openings 112 are structured.

Thus, in comparison with conventional circular waveguide array antennas, apertures of the array elements are broadened.

At a rear side from the radiation plane of the horn-type circular waveguide plate 111, a stripline circuit sheet 114, an electromagnetic wave reflection plate 115 and a feeding port plate 116 are provided, and are respectively electrically connected with bolts or the like. The stripline circuit sheet 114 is for feeding the circular waveguides, which structure feeding portions. During feeding of the array element openings 112, the electromagnetic wave reflection plate 115 returns electromagnetic waves which radiate from distal ends of striplines 121 of the stripline circuit sheet 114 to the upper portion openings. The feeding port plate 116 feeds a common terminal of the feeding striplines.

At the stripline circuit sheet 114, the striplines 121 provided thereon are sandwiched by sheets of dielectric material. A dielectric sheet, which is at lower portions of respective horn-type circular waveguides 131 of the horn-type circular waveguide plate 111, is removed at portions with shapes matching the horn-type conical horns 112. Thus, only distal end portions of the striplines 121 are exposed, and radiate electromagnetic waves.

This is a structure matching the horn-type circular waveguide antenna described with FIG. 1. Feeding terminals of all the striplines 121, which are guided to the lower portions of all the horn-type circular waveguides 112 of the horn-type circular waveguide plate 111, branch from the common terminal. The common terminal receives electricity supplied through coaxial wiring through a feeding port 123 of the plate 116.

At the electromagnetic wave reflection plate 115, non-penetrating cylindrical cavities 122 with positions and diameters the same as all the horn-type circular waveguides 112 of the horn-type circular waveguide plate 111, are formed in the electromagnetic wave reflection plate for reflecting the electromagnetic waves that radiate downward from the feeding terminals of the striplines 121 back upward. The plate 116 is a plate including the antenna feeding port 123, and is electrically connected with other apparatus through the feeding port 123.

Thus, in this seventh embodiment of the present invention, the horn-type circular waveguide plate 111 differs from a conventional circular waveguide array antenna but the embodiment is otherwise the same.

Here, the horn-type circular waveguide plate 111, the electromagnetic wave reflection plate 115 and the feeding port plate 116 employ brass members, aluminium members and/or conductive plastic members.

Each array element opening 112 of the horn-type circular waveguide plate 111 receives electricity supplied from the feeding terminal of the stripline 121, and has a structure the same as the horn-type circular waveguide antenna shown in FIG. 1. With the wavelength $\lambda$ of the central frequency and the diameter a of the circular waveguide 52 being established and half the opening angle being $\alpha$, the array element opening 112 is formed such that the diameter d and the flare L are set so as to satisfy equation (2).

Therefore, radiation efficiencies of the array elements which are horn-type circular waveguide antennas are at a maximum and reflection losses are at a minimum, and radiation efficiency of the circular waveguide array antenna of the present invention can be maximized and reflection losses minimized.

Next, operation of the circular waveguide antenna which illustrates the seventh embodiment of the present invention will be described using FIGS. 12A and 12B.

When electromagnetic waves are fed through the feeding port 123 of the plate 116, a distal end of the coaxial wire, which is directly connected to the common terminal of the striplines provided at the stripline circuit sheet 114 for feeding the circular waveguides, receives the electromagnetic waves and feeds the electromagnetic waves to the common terminal of the striplines. Hence, because physical shapes and conditions until the distal ends of the striplines which feed the circular waveguides are the same, the electromagnetic waves are fed from the common terminal of the striplines to the distal ends of the respective striplines with matching phases in terms of electrical power.

Directions of the distal ends of the respective striplines are matching directions. Therefore, electric field distributions of the apertures 112 of the respective horn-type circular waveguide antennas receiving electricity supplied through the stripline distal ends are matching directions, and polarization planes at the horn-type circular waveguide plate 111 which is the radiation plane of the antennas are aligned. Therefore, a deterioration in radiation characteristics of the antennas does not occur.

The electromagnetic waves fed through the feeding port 123 are ultimately fed, in equal proportions, to all the horn-type circular waveguide apertures 112 formed in the horn-type circular waveguide plate 111, and hence radiated.

Here, as the opening angle of the horn-type circular waveguides 112 of the horn-type circular waveguide plate 111 is increased from 0°, then as shown in FIG. 7B, if, for example, $d/\lambda=3$, the diameter d of the opening increases accordingly, and the radiation gain of the antenna continuously increases up to the optimum value represented in equation (2).

As described above, the horn-type circular waveguides 112 are formed in the conductor plate, and the horn-type circular waveguide plate 111 is constituted, such that the conical horns each satisfy equation (2). Thus, radiation characteristics, particularly radiation gain, can be increased.

Furthermore, the radiation gain increasing means that supplied electromagnetic waves are more efficiently radiated from the antennas, and thus that, while propagating within the antennas, less electric power of the electromagnetic waves is reflected and returned back to the feeding openings 123. Thus, a reflection loss characteristic of the antennas, which is to say the S11 parameter, can be ameliorated.

Further, because the S11 parameter can be improved, there is no need to arrange a matching circuit and filter, or isolator or the like, prior to the feeding port 123 for cases of characteristics of the device deteriorating or the device becoming inoperable due to adverse effects of reflected waves in a high frequency circuit. Therefore, the device can be produced at smaller size and lower price.

Herein, it is most preferable if the array element opening 112 is formed so as to satisfy equation (2), with half of the opening angle being $\alpha$, but a range between $0.8\times\mathrm{Arcsin}(0.1349114/(d/\lambda))$ and $1.2\times\mathrm{Arcsin}(0.1349114/(d/\lambda))$ is acceptable.

In regard to applications, the circular waveguide array antenna of the present invention can be used for communications with millimeter waves and sub-millimeter waves, and employment as an antenna for contemporary ETC, ITS or the like is possible, similarly to conventional slot array antennas.

Furthermore, if a number of the circular waveguide array elements is increased, radiation gain is increased further and a main beam width is sharpened, and thus utilization in systems which require high-gain antennas such as parabola antennas is possible. Examples include telephony communications base station relay antennas, television base station relay antennas, satellite communications antennas, radio telescope antennas for radio astronomy, and so forth.

Eighth Embodiment

The present embodiment further refines the horn-type circular waveguide plate 111 which acts as the upper portion openings of the array elements of the seventh embodiment, and provides a more compact circular waveguide array antenna.

Figure 14A:
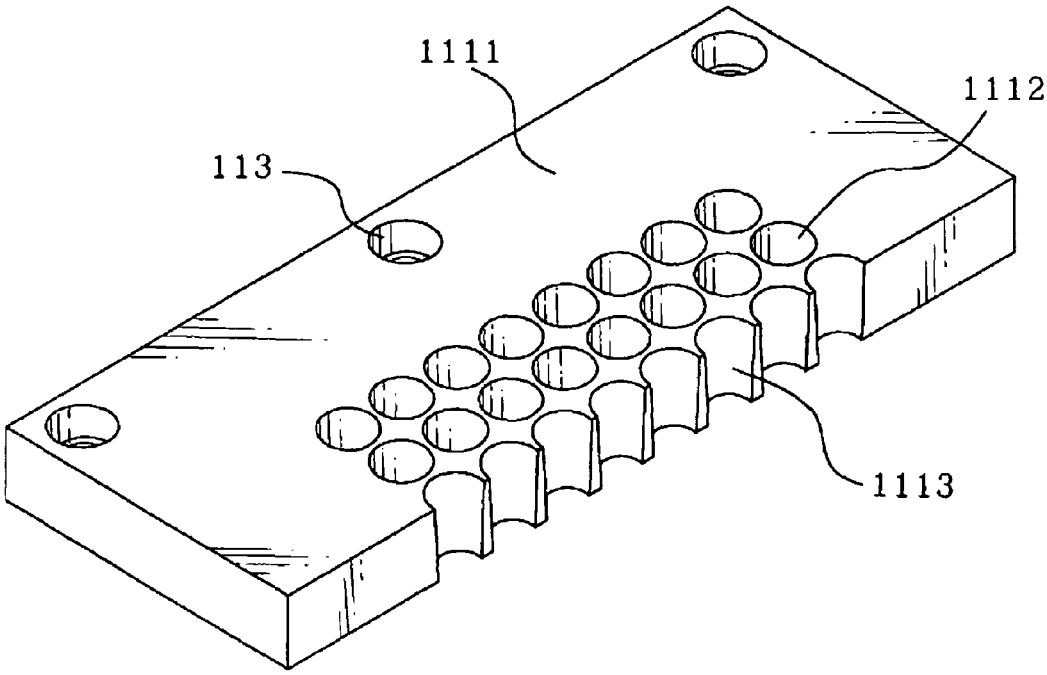
FIG. 14A is a structural view of a horn-type circular waveguide plate of a circular waveguide array antenna which illustrates an eighth embodiment of the present invention.
Figure 14B:
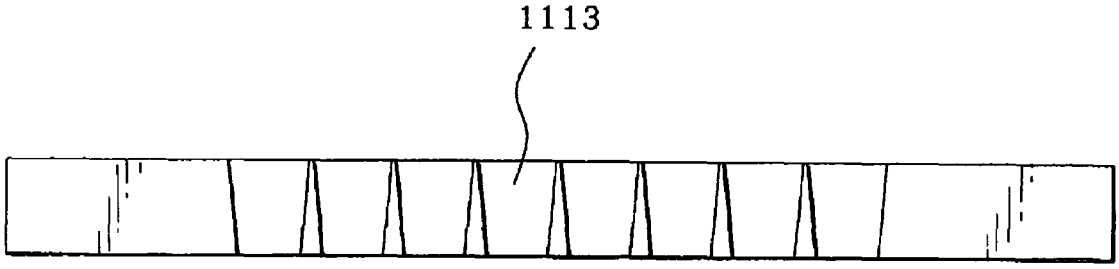
FIG. 14B is a structural view of a horn-type circular waveguide plate of a circular waveguide array antenna which illustrates an eighth embodiment of the present invention.

FIGS. 14A and 14B are structural views of a plate of a horn-type circular waveguide which illustrates the eighth embodiment. FIG. 14A is a perspective sectional view of the horn-type circular waveguide plate and FIG. 14B is a sectional view seen in front elevation.

Structure of the circular waveguide array antenna of the present embodiment is basically the same as in the seventh embodiment. Thus, descriptions of all structures will not be given but the plate of the horn-type circular waveguides, of which structure is different, will be described.

In FIGS. 14A and 14B, at the radiation plane of the antenna, horn-type circular waveguides which act as the upper portion openings of the array elements are machined in a square region of a horn-type circular waveguide plate 1111 with equal spacings. Array element apertures 1112, array element horn-type circular waveguides 1113 and the screw holes 113, which are required when assembling the antenna and when fixing the antenna to other apparatus, are formed in the horn-type circular waveguide plate 1111.

The array element horn-type circular waveguides 1113 are through-holes with conical shapes. In FIGS. 13A and 13B of the seventh embodiment, array element horn-type circular waveguides 131 which are formed in the horn-type circular waveguide plate 111 are integrally structured by cylinder-form portions 131*b* and cone-form portions 131*a*. In the present embodiment however, as shown in FIGS. 14A and 14B, there are no portions corresponding to the cylinder-form portions 131*b*. Accordingly, the horn-type circular waveguide plate 1111 can be made thinner by a thickness corresponding to the cylinder-form portions 131*b*.

Now, operation of the circular waveguide array antenna which illustrates the eighth embodiment of the present invention is the same as operation of the circular waveguide array antenna of the seventh embodiment, and descriptions will not be given. In the case of the seventh embodiment, the cylinder-form portions 131*b* are present, and the cylinder-form portions 131*b* are non-lossy waveguides. Therefore, the electromagnetic waves are propagated in amounts corresponding to the cylinder-form portions 131*b* that are present and, although phase is delayed in correspondence with distances of the cylinder-form portions 131*b*, there is no effect on antenna characteristics. In the case of the eighth embodiment, the cylinder-form portions 131*b* are not present, there is no delay in phase of the electromagnetic waves which are propagated inside the antenna, and there is no effect at all on antenna characteristics.

As long as portions corresponding to the forms of boundary lines 132 of the seventh embodiment are circular with a diameter the same as the diameter of the cylinder-form portions 131*b*, the cylinder-form portions 131*b* may be eliminated.

As described above, the cylinder-form portions are removed from the horn-type circular waveguides of the horn-type circular waveguide plate 1111, and only conical-form horns are structured. Therefore, thickness of the horn-type circular waveguide plate 1111 can be made thinner by an amount corresponding to the cylindrical portions of the horn-type circular waveguides of the array elements, and a further reduction in size and reduction in weight of the circular waveguide array antenna are enabled.

Here, because the circular waveguide array antenna of the present embodiment has similar characteristics to the circular waveguide array antenna of the seventh embodiment, applications are the same as the applications mentioned for the seventh embodiment.

Ninth Embodiment

Figure 31A:
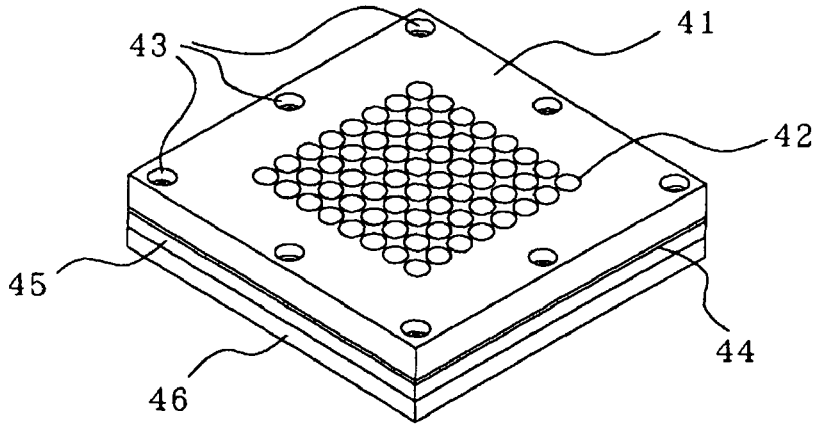
FIG. 31A PRIOR ART
FIG. 31A is a structural view of a previous circular waveguide array antenna.
Figure 31B:
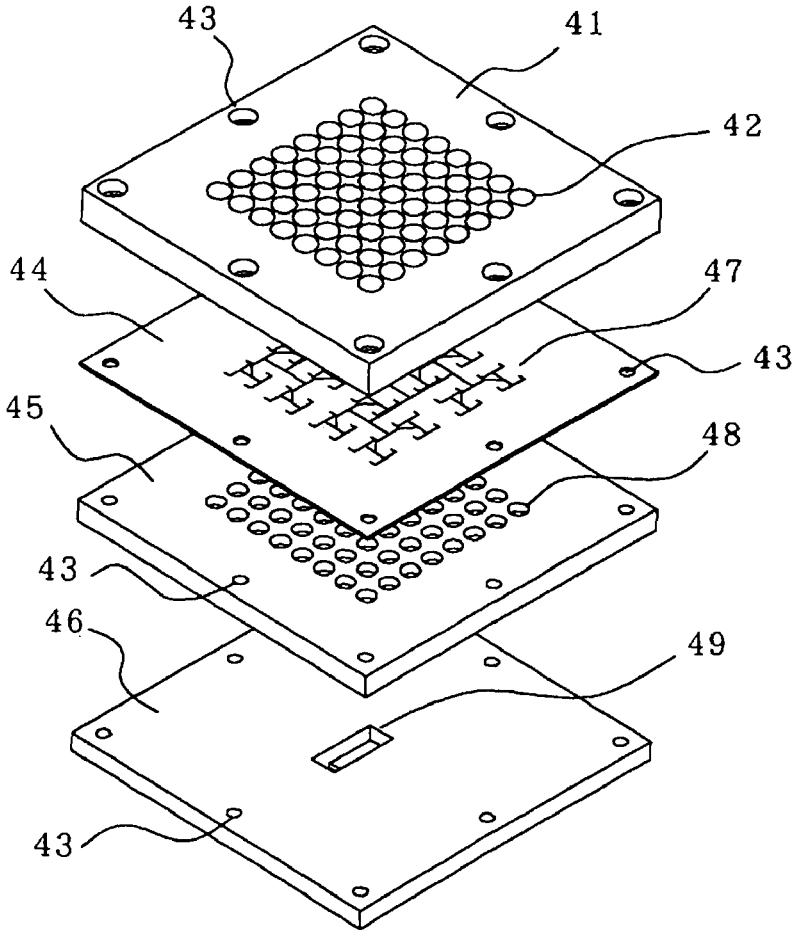
FIG. 31B PRIOR ART
FIG. 31B is a structural view of a previous circular waveguide array antenna.
Figure 32A:
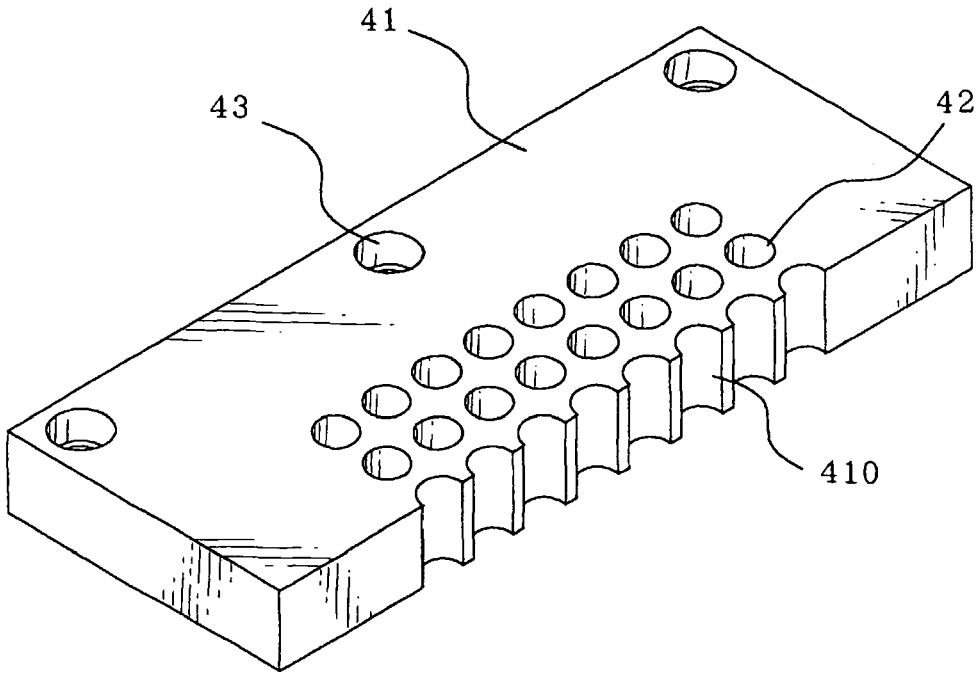
FIG. 32A PRIOR ART
FIG. 32A is a structural view of a circular waveguide plate of the previous circular waveguide array antenna.
Figure 32B:
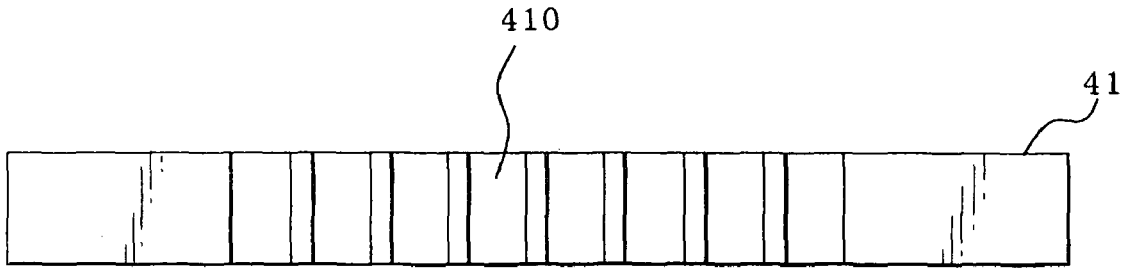
FIG. 32B PRIOR ART
FIG. 32B is a structural view of a circular waveguide plate of the previous circular waveguide array antenna.

The present embodiment adds the horn-type circular waveguide plate 111 which acts as the upper portion openings of the array elements of the seventh embodiment (FIGS. 13A and 13B) onto the circular waveguide plate 41 which acts as upper portion openings of array elements of a conventional circular waveguide array antenna (FIGS. 31A and 31B). In accordance with requirements, a single antenna can be employed as a circular waveguide array antenna as conventionally or can be employed as a horn-type circular waveguide array antenna as in the seventh embodiment.

Figure 15:
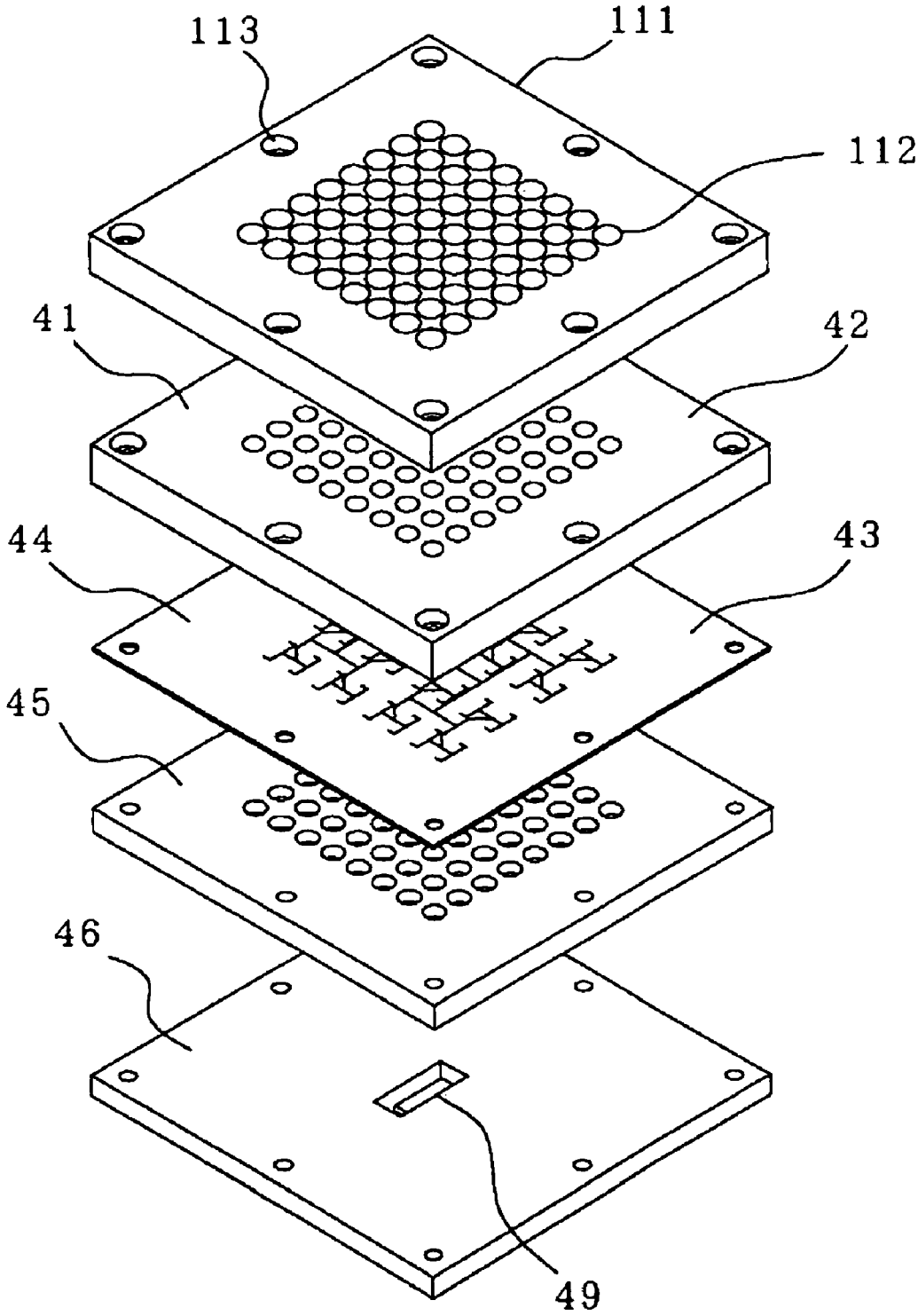
FIG. 15 is an exploded perspective view of a circular waveguide array antenna which illustrates a ninth embodiment of the present invention.
Figure 16:
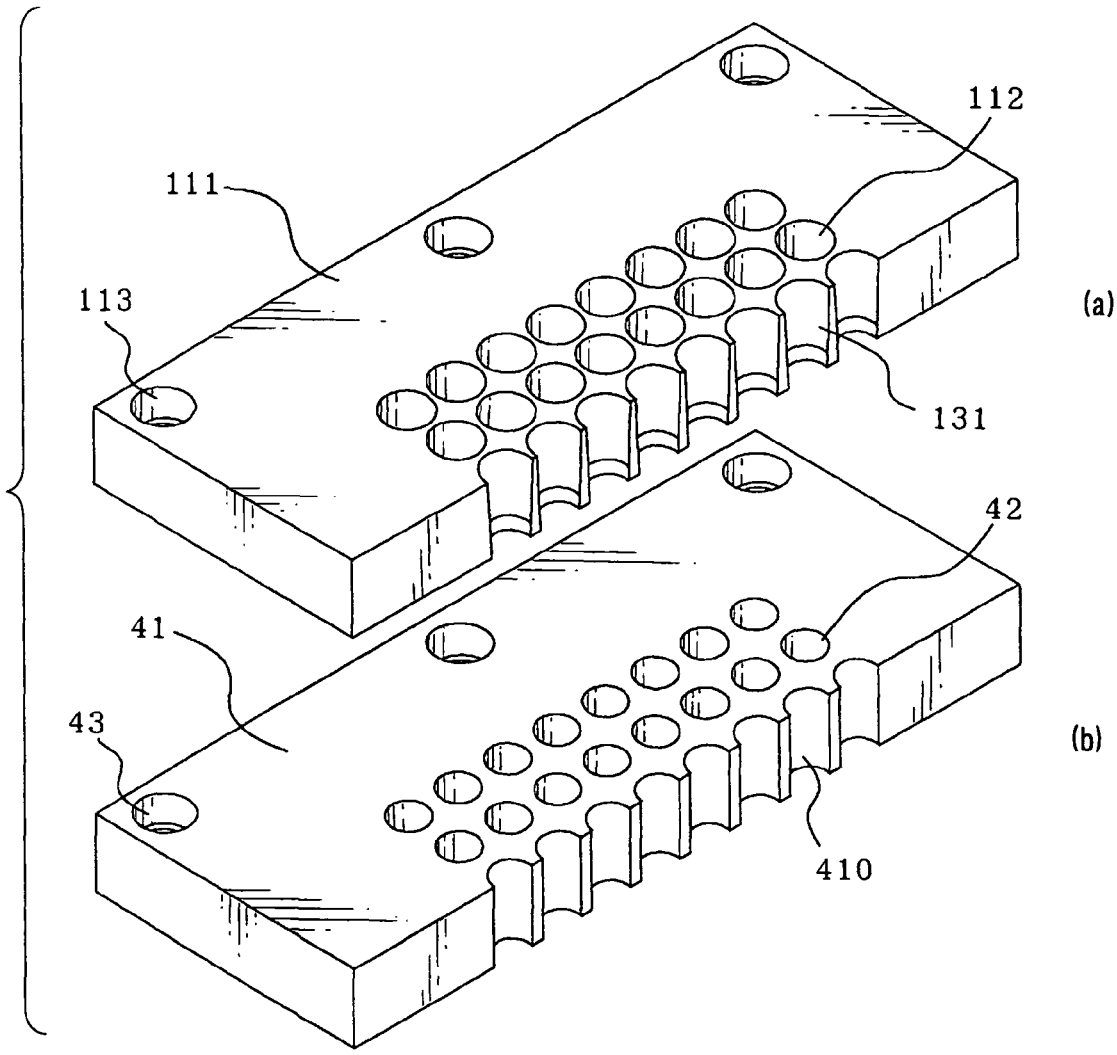
FIG. 16 is a perspective view prior to assembly of a horn-type circular waveguide plate of the circular waveguide array antenna which illustrates the ninth embodiment of the present invention.
Figure 17:
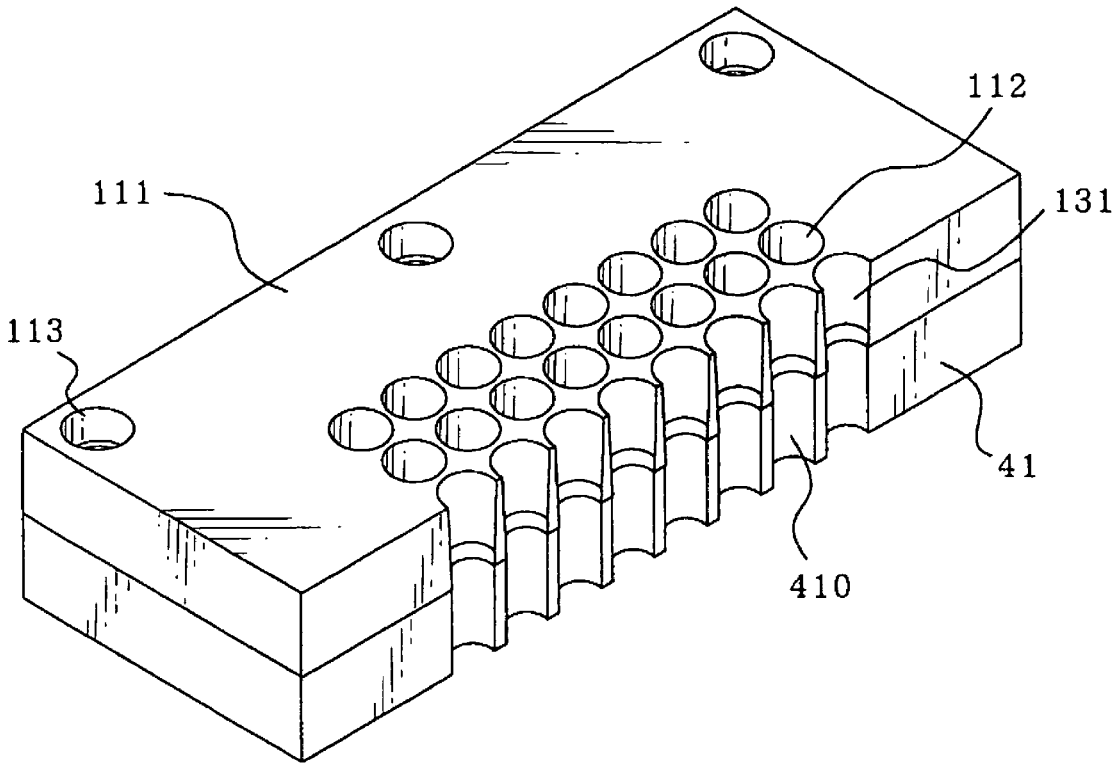
FIG. 17 is a perspective view subsequent to assembly of the horn-type circular waveguide plate of the circular waveguide array antenna which illustrates the ninth embodiment of the present invention.

FIG. 15 is an exploded perspective view of a circular waveguide array antenna. FIG. 16 ((*a*), (*b*)) is a perspective view of a horn-type circular waveguide plate of FIG. 15. FIG. 16 (*a*) is a perspective sectional view of the horn-type circular waveguide plate of the seventh embodiment, and FIG. 16 (*b*) is a perspective sectional view of a circular waveguide plate of a conventional circular waveguide array antenna. FIG. 17 is a perspective sectional view of the circular waveguide plate after assembly.

With FIGS. 16 to 17, portions the same as or corresponding to FIGS. 13A and 13B of the seventh embodiment or FIGS. 31A and 31B of the conventional example are assigned the same reference numerals and will not be described.

In FIG. 17, the horn-type circular waveguide plate 111 of the seventh embodiment is disposed on the circular waveguide plate 41 of the conventional circular waveguide array antenna, and the horn-type circular waveguide plate 111 is fixed by bolts passing through the fixing screw holes 113 and 43 such that arrangements of the openings 42 of the circular waveguide plate 41 and the array element horn-type circular waveguides 131 formed in the horn-type circular waveguide plate 111 coincide. Thus, the horn-type circular waveguide plate 111 and the circular waveguide plate 41 are integrated, and this is a structure similar to the horn-type circular waveguide plate 111 of the seventh embodiment.

Because this structure is similar to the horn-type circular waveguide plate 111 of the seventh embodiment, operation of the circular waveguide array antenna of the ninth embodiment is identical to operation of the circular waveguide array antenna of the seventh embodiment.

As described above, the circular waveguide array antenna of the present embodiment retains the structure of a conventional circular waveguide array antenna and attaches the horn-type circular waveguide plate 111 illustrated in the seventh embodiment thereto. Thus, when employment as the conventional circular waveguide array antenna is required, it is sufficient to detach the horn-type circular waveguide plate 111.

Accordingly, the circular waveguide array antenna of the present embodiment can, depending on usage conditions, fulfill the functions of the circular waveguide array antenna of the seventh embodiment and of the conventional circular waveguide array antenna, and a circular waveguide array antenna with higher functionality and lower price can be achieved.

Because characteristics of the circular waveguide array antenna of the present embodiment are also the same as with the circular waveguide array antenna of the seventh embodiment, applications are the same as the applications mentioned for the seventh embodiment.

Tenth Embodiment

The present embodiment adds the horn-type circular waveguide plate 1111 which acts as the upper portion openings of the array elements of the eighth embodiment (FIGS. 14A and 14B) onto the circular waveguide plate 41 which acts as the upper portion openings of the array elements of the conventional circular waveguide array antenna (FIGS. 31A and 31B). In accordance with requirements, a single antenna can be employed as a circular waveguide array antenna as conventionally or can be employed as a horn-type circular waveguide array antenna as in the seventh embodiment.

Figure 18:
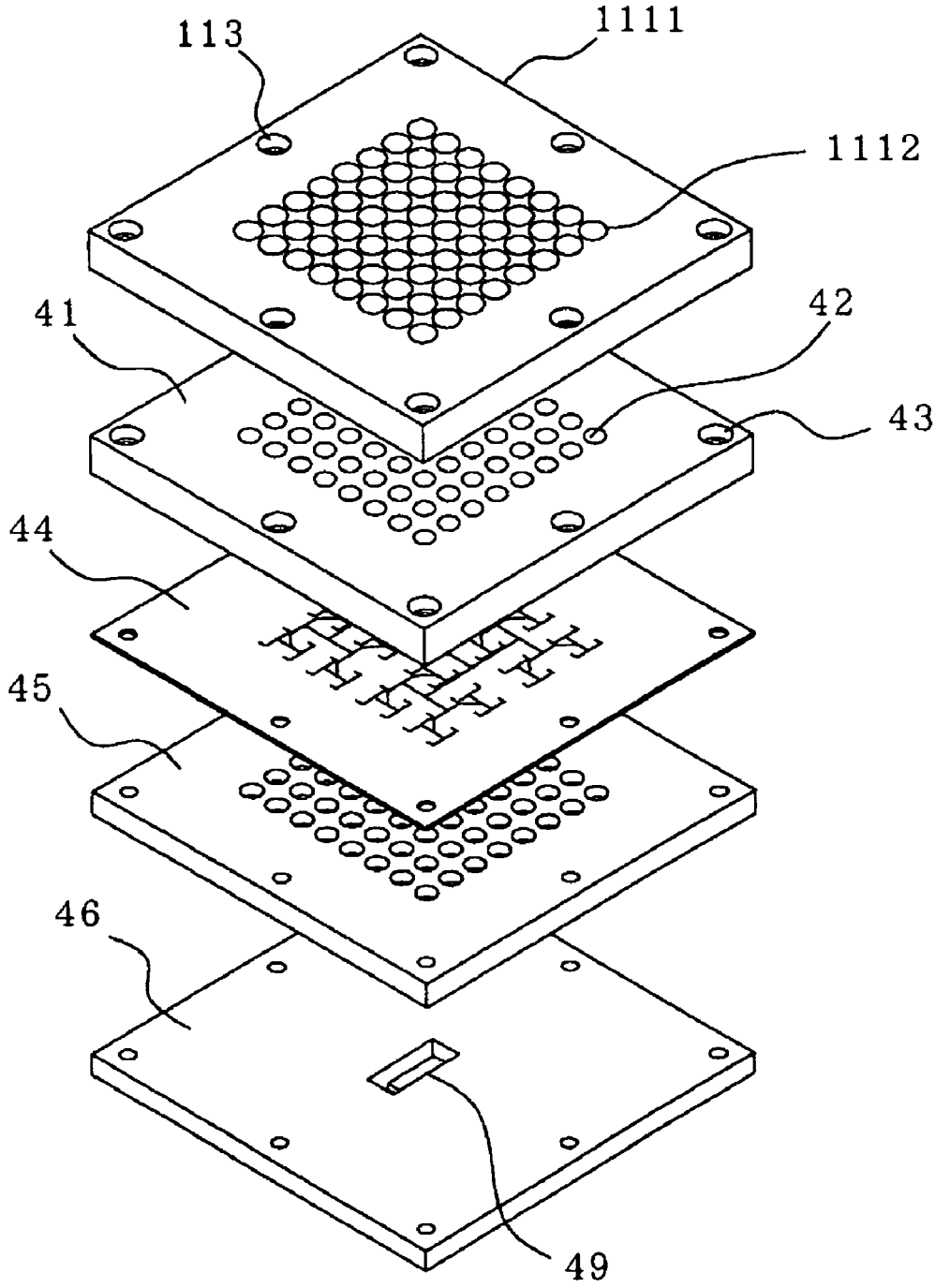
FIG. 18 is an exploded perspective view of a circular waveguide array antenna which illustrates a tenth embodiment of the present invention.
Figure 19:
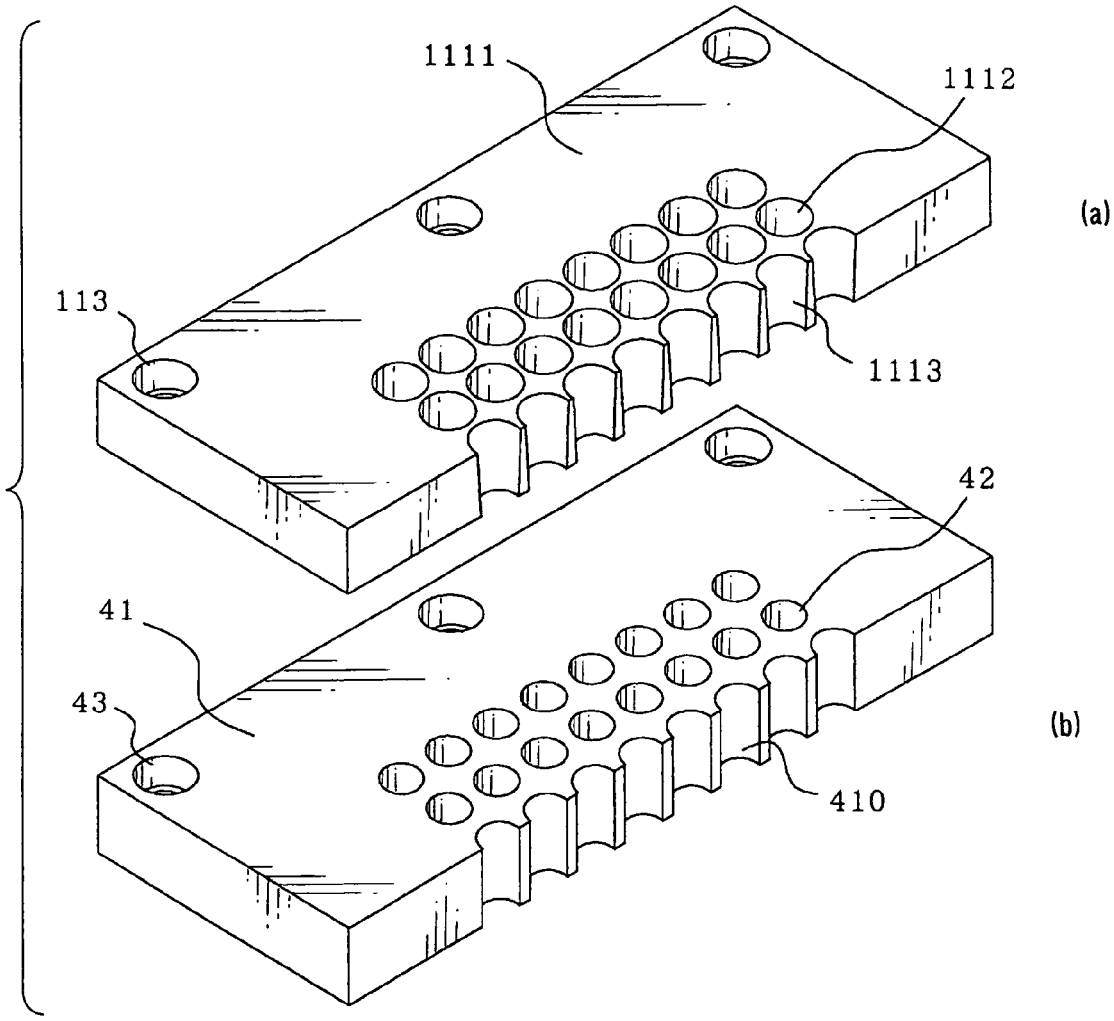
FIG. 19 is a perspective view prior to assembly of a horn-type circular waveguide plate of the circular waveguide array antenna which illustrates the tenth embodiment of the present invention.
Figure 20:
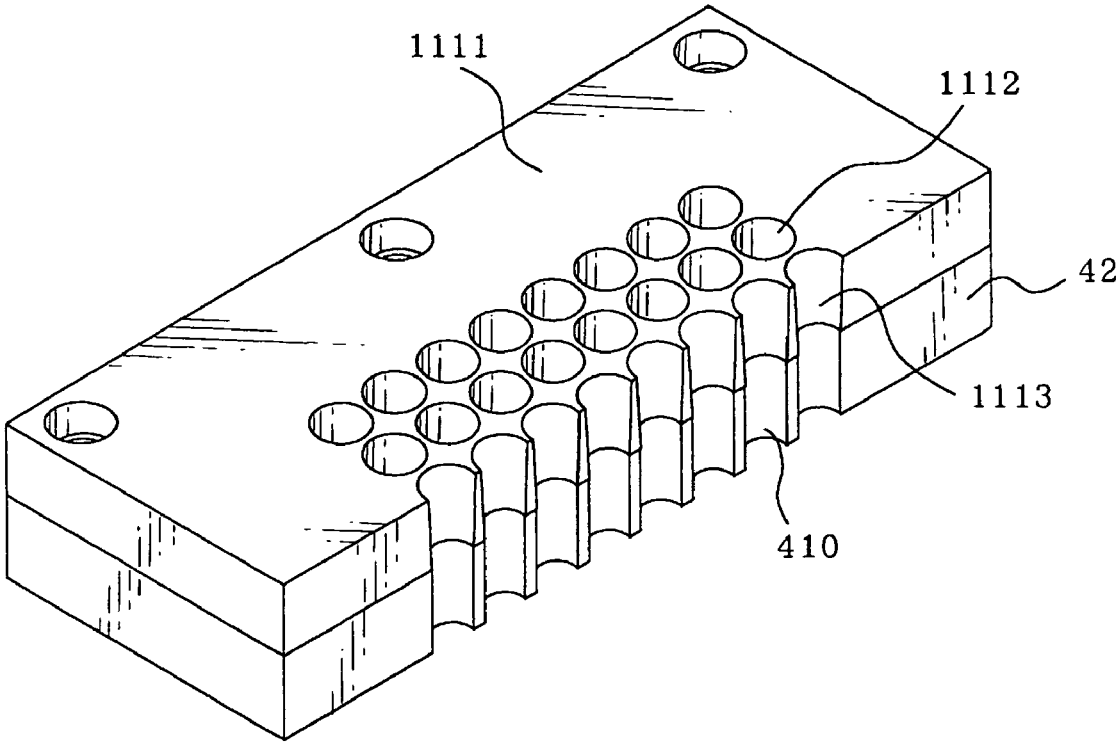
FIG. 20 is a perspective view subsequent to assembly of the horn-type circular waveguide plate of the circular waveguide array antenna which illustrates the tenth embodiment of the present invention.

FIG. 18 is an exploded perspective view of a circular waveguide array antenna which illustrates the tenth embodiment. FIG. 19 ((*a*), (*b*)) is a perspective views of a horn-type circular waveguide plate of FIG. 18. FIG. 19 (*a*) is a perspective sectional view of the horn-type circular waveguide plate of the eighth embodiment and FIG. 19 (*b*) is a perspective sectional view of the circular waveguide plate of the conventional circular waveguide array antenna. FIG. 20 is a perspective sectional view of the circular waveguide plate after assembly.

With FIGS. 18 to 19, portions the same as or corresponding to FIGS. 14A and 14B of the eighth embodiment or FIGS. 31A and 31B of the conventional example are assigned the same reference numerals and will not be described.

In FIG. 20, the horn-type circular waveguide plate 1111 of the eighth embodiment is disposed on the circular waveguide plate 41 of the conventional circular waveguide array antenna, and the horn-type circular waveguide plate 1111 is fixed by bolts passing through the fixing screw holes 113 and 43 such that arrangements of the openings 42 of the circular waveguide plate 41 and the array element horn-type circular waveguides 1113 formed in the horn-type circular waveguide plate 1111 coincide. Thus, the horn-type circular waveguide plate 1111 and the circular waveguide plate 41 are integrated, to form a structure similar to the horn-type circular waveguide plate 1111 of the eighth embodiment, and this can be employed as a horn-type circular waveguide array antenna.

Because this structure is similar to the array element horn-type circular waveguides 1113 the eighth embodiment, operation of the circular waveguide array antenna of the present embodiment is identical to operation of the circular waveguide array antenna of the seventh embodiment.

As described above, the circular waveguide array antenna of the present embodiment retains the structure of conventional circular waveguide array antenna and attaches the horn-type circular waveguide plate 1111 illustrated in the eighth embodiment thereto. Thus, when employment as the conventional circular waveguide array antenna is required, it is sufficient to detach the horn-type circular waveguide plate 1111.

Consequently, the circular waveguide array antenna of the present embodiment can, depending on usage conditions, fulfill the functions of the circular waveguide array antenna of the eighth embodiment and the conventional circular waveguide array antenna, and a circular waveguide array antenna with higher functionality and lower price can be achieved.

Because characteristics of the circular waveguide array antenna of the present embodiment are also the same as with the circular waveguide array antenna of the eighth embodiment, applications are the same as the applications mentioned for the eighth embodiment.

Eleventh Embodiment

Conventionally, when structuring an array antenna, a spacing of neighboring array elements must be set to no more than a wavelength λ, such that a main lobe of a radiation directional characteristic of the overall antenna is orthogonal with respect to array element rows or a plane in which the array elements are arranged, and additionally preventing the occurrence of grating lobes.

Figure 22A:
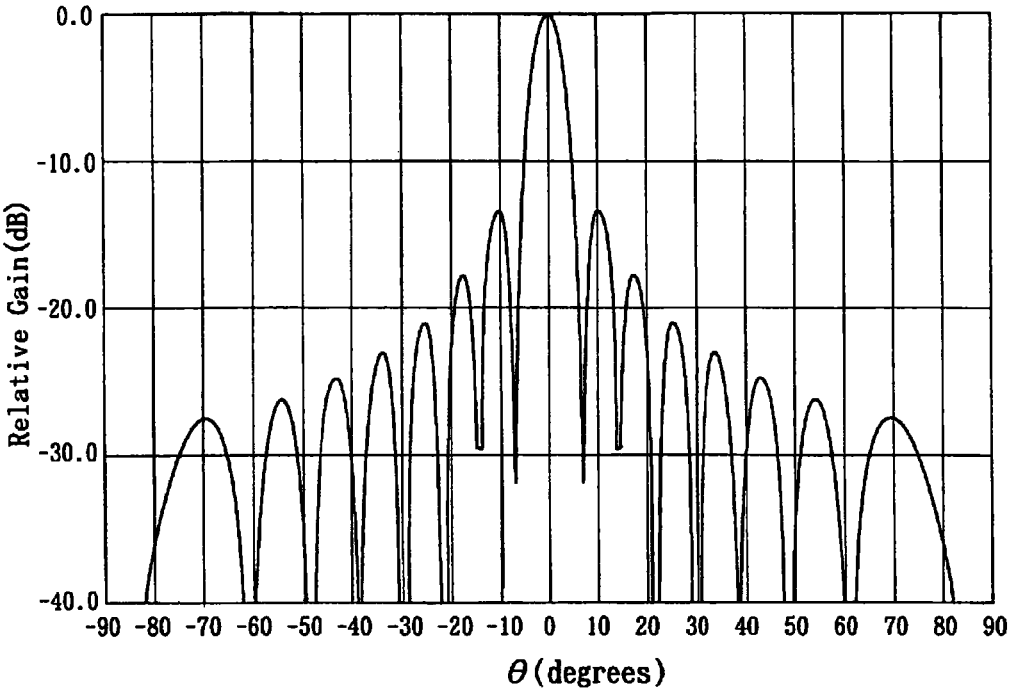
FIG. 22A is a graph of radiation directional characteristics of an array antenna with a uniform surface phase distribution and electric power distribution.
Figure 22B:
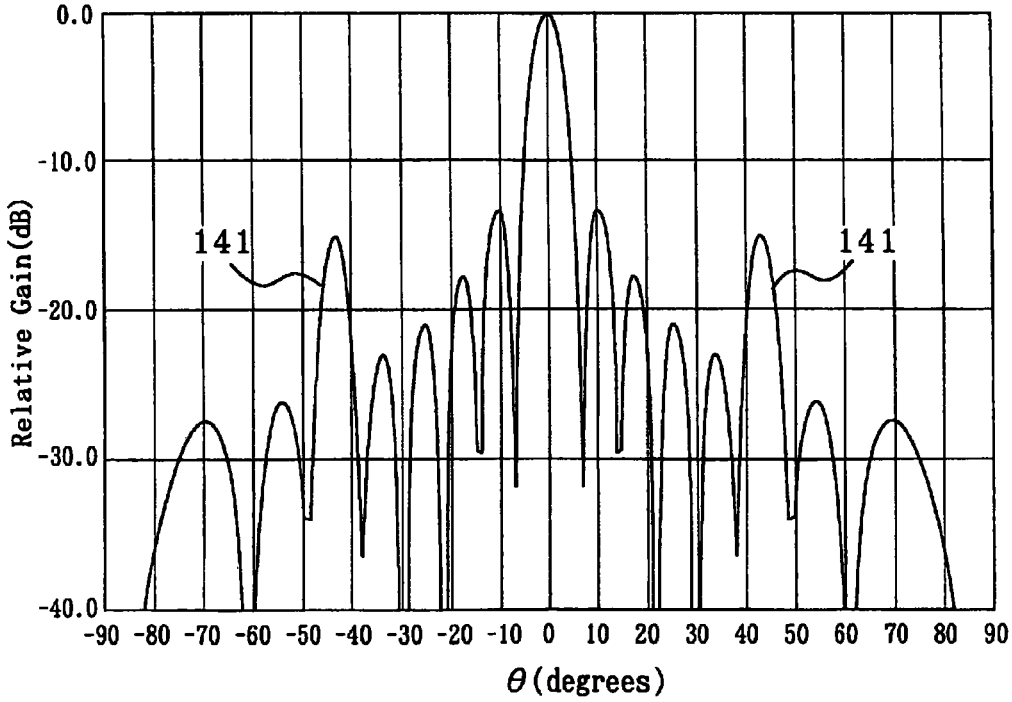
FIG. 22B is a graph of radiation directional characteristics of an array antenna with a uniform surface phase distribution and electric power distribution.

FIGS. 22A and 22B show examples of radiation directional characteristics of array antennas with uniform surface phase distribution and electric field distribution. FIG. 22A is a radiation directivity characteristic with a spacing of neighboring array elements being a wavelength λ or less, and it can be seen that lobe levels progressively decrease moving away from the main lobe. FIG. 22B is a radiation directional characteristic in which the spacing of neighboring array elements is more than λ. The lobe levels progressively decrease moving away from the main lobe but, counting from first side lobes, the level of the fifth lobes is higher, and depending on that level, may adversely affect overall radiation directional characteristics. The lobes 141 are the above-mentioned grating lobes.

However, as is clear from FIG. 7A, as $d/\lambda$ ($d/\lambda \leqq 1$) becomes larger, the radiation gain G becomes higher, and is large when $d/\lambda=1$, and the radiation gain G of array elements is a maximum when the opening angle α of the horn antennas is 7.7530°, being 9.171486 dB.

Therefore, if the aperture diameter d of the circular waveguide array elements of the present invention is brought as close to λ as possible, the radiation gain G of the horn antenna is high while, as shown in FIG. 22A, grating lobes, which are one cause of a characteristic deterioration in the directional characteristic, do not occur. Even if, for example, the value of d is slightly larger than λ, although the grating lobes occur, there is no problem if they are at such a level as not to adversely affect the radiation directional characteristic.

The present embodiment is a structure in which a horn-type circular waveguide, which is an array element of the seventh embodiment, is formed so as to satisfy the conditions described above.

Figure 21A:
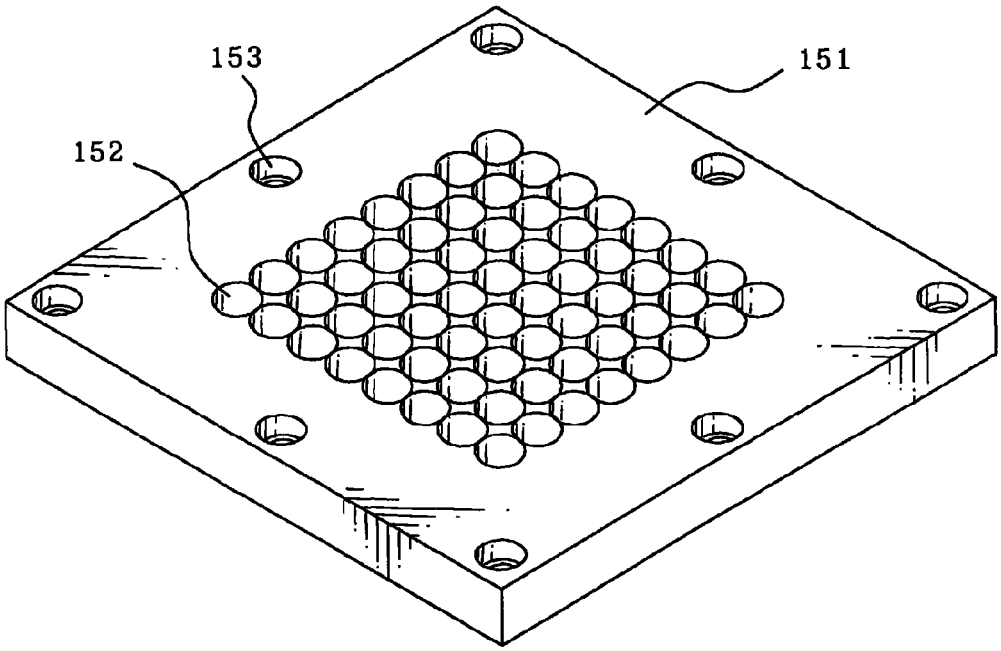
FIG. 21A is a perspective views of a horn-type circular waveguide plate of a circular waveguide array antenna which illustrates an eleventh embodiment of the present invention.
Figure 21B:
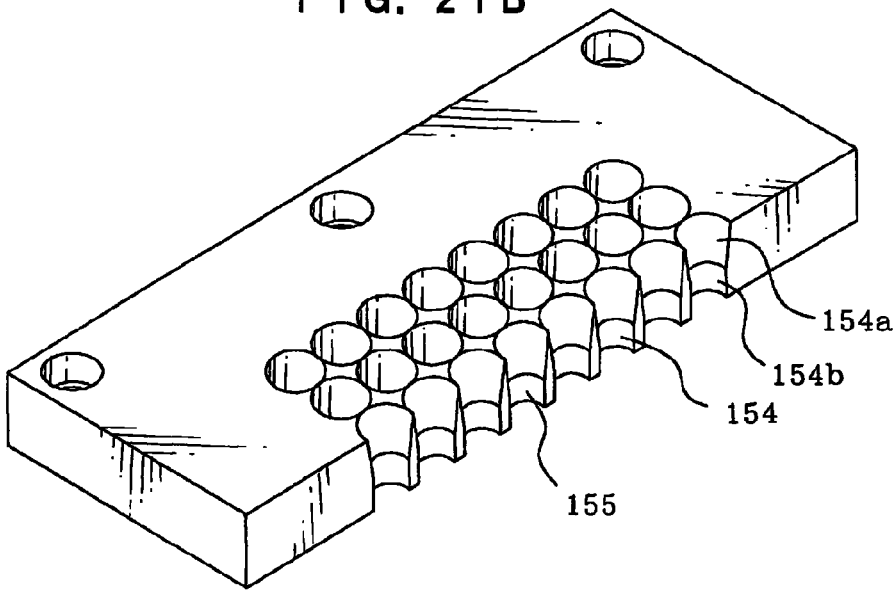
FIG. 21B is a perspective views of a horn-type circular waveguide plate of a circular waveguide array antenna which illustrates an eleventh embodiment of the present invention.

FIGS. 21A and 21B are structural views of a horn-type circular waveguide plate which illustrates the eleventh embodiment. FIG. 21A is a view of the horn-type circular waveguide plate, and FIG. 21B is a sectional view, seen from an oblique angle.

In FIGS. 21A and 21B, horn-type circular waveguides, which act as upper portion openings of array elements, are machined with equal spacings in a square region of a horn-type circular waveguide plate 151. Array element openings 152, array element horn-type circular waveguides 154 and screw holes 153, which are required when assembling the antenna and when fixing the antenna to other apparatus, are formed in the horn-type circular waveguide plate 151.

The horn-type circular waveguides 154 are integrally structured by cylinder-form portions 154*b* and cone-form portions 154*a*.

At the horn-type circular waveguide plate 151, the horn-type circular waveguides 154 formed in the horn-type circular waveguide plate 151 have characteristics the same as shown in the above-mentioned FIG. 7A, and shapes thereof are prescribed as described below.

(1) A spacing of the horn-type circular waveguides 154 that are neighboring array elements (array element openings 152) is equal or substantially equal to the wavelength λ.

(2) The diameter d of the array element openings 152 at the apertures of the horn-type circular waveguides 154 which are array elements are equal or substantially equal to λ.

(3) The opening angle 2α of the horn-type circular waveguides 154 which are array elements is approximately 2×7.7530°.

A limit for which grating lobes do not occur is that the spacing of neighboring array elements is up to λ, but if the diameter d of the array element openings 152 at the apertures of the horn-type circular waveguides 154 which are array elements is at λ, cutting of the horn-type circular waveguide plate 151 will be difficult. Therefore, making the spacing of neighboring array elements slightly larger than λ by a few tens of microns is allowable. Theoretically, when the spacing of neighboring array elements exceeds λ, grating lobes occur. However, if this is of the order of tens of microns, the grating lobes will not be to a level so high as to adversely affect radiation directional characteristics of the overall antenna.

In this structure, the spacing of the array elements formed on the horn-type circular waveguide plate 151 and the diameter d of the opening apertures of the array elements are set equal or substantially equal to λ. Therefore, grating lobes will not significantly occur. Operations are identical to the circular waveguide array antenna of the seventh embodiment, so will not be described.

As described above, the horn-type circular waveguides 154 formed in the horn-type circular waveguide plate 151 of the circular waveguide array antenna of the present embodiment are formed with the conditions described above. Thus, the radiation gain G of the respective array elements can be substantially maximized. Therefore, the circular waveguide array antenna of the present embodiment, in addition to the effects exhibited by the circular waveguide array antenna of the seventh embodiment, can bring the radiation gain up to a maximum and can suppress reflection losses of the antenna to a minimum.

In addition, there is an advantage in that, with the same radiation gain, for example, a transmission range becomes further or the form of the antenna becomes smaller by an amount corresponding to improvements in radiation characteristics and reflection loss characteristics. Thus, in addition to a reduction in price and reduction in size of the circular waveguide array antenna, the present embodiment can further improve capabilities.

Applications of the circular waveguide array antenna of the present embodiment are the same as the applications mentioned for the seventh embodiment.

Twelfth Embodiment

The present embodiment further improves the horn-type circular waveguide plate 151 which acts as upper portion openings of array elements in the eleventh embodiment, to form an even smaller circular waveguide array antenna.

Figure 23A:
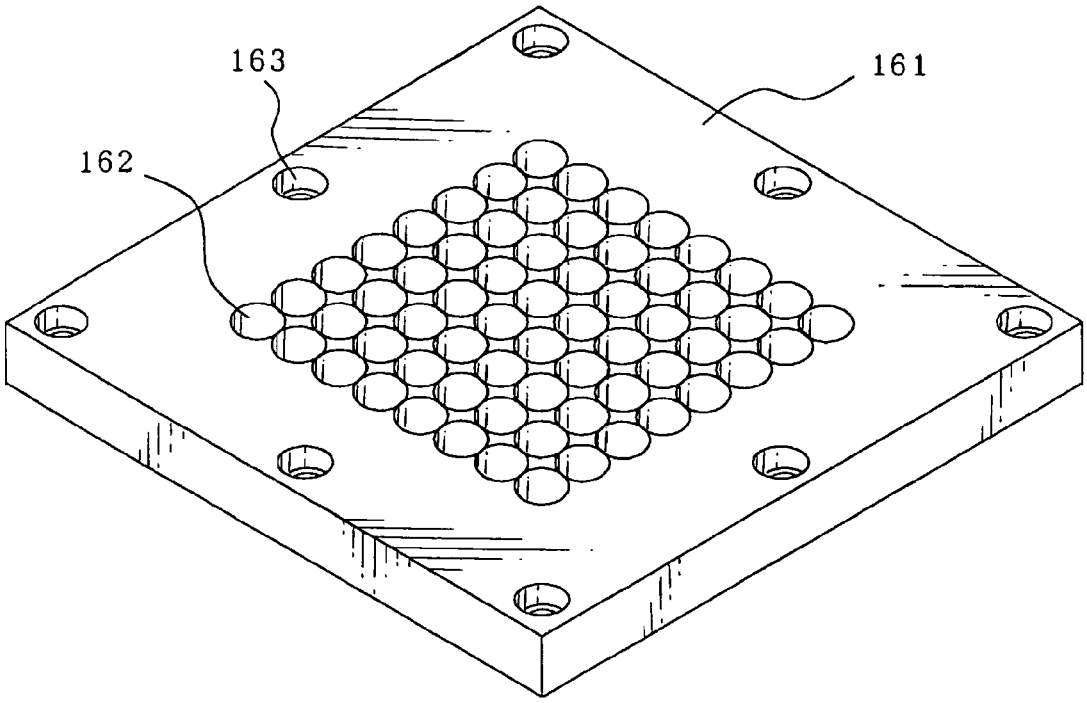
FIG. 23A is a structural view of a horn-type circular waveguide plate of a circular waveguide array antenna which illustrates a twelfth embodiment of the present invention.
Figure 23B:
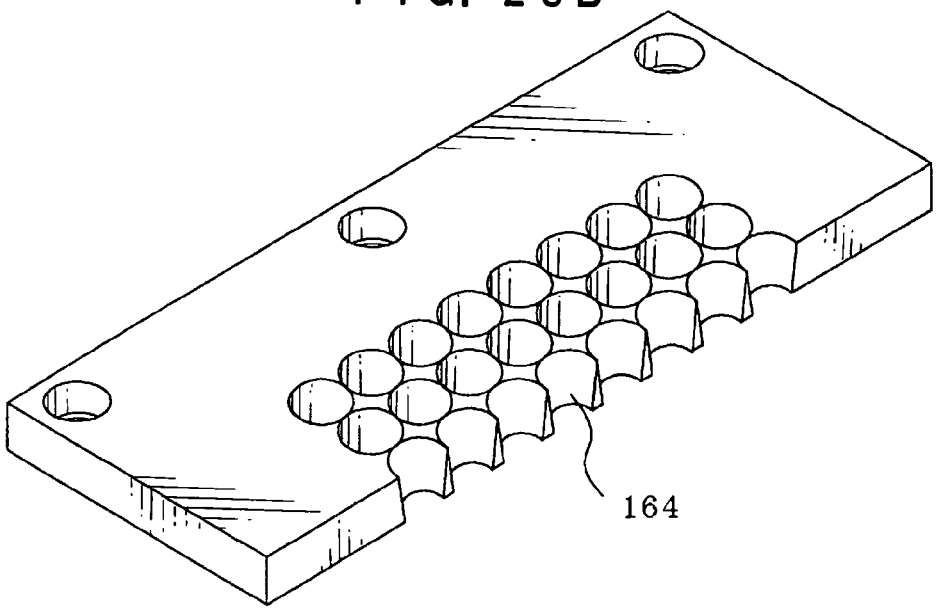
FIG. 23B is a structural view of a horn-type circular waveguide plate of a circular waveguide array antenna which illustrates a twelfth embodiment of the present invention.

FIGS. 23A and 23B are structural views of a plate of a horn-type circular waveguide which illustrates the twelfth embodiment. FIG. 23A is a perspective exterior view of the horn-type circular waveguide plate, and FIG. 23B is a sectional view seen from an oblique angle.

Structure of the circular waveguide array antenna of the present embodiment is basically the same as in the eleventh embodiment and overall structure will not be described, but the plate of the horn-type circular waveguide, which differs in structure, will be described.

In FIGS. 23A and 23B, horn-type circular waveguides, which act as upper portion openings of array elements, are machined with equal spacings in a square region of a horn-type circular waveguide plate 161. Array element openings 162, array element horn-type circular waveguides 164 and screw holes 163, which are required when assembling the antenna and when fixing the antenna to other apparatus, are formed in the horn-type circular waveguide plate 161.

The horn-type circular waveguides 164 are conical through-holes. In FIGS. 21A and 21B for the eleventh embodiment, the array element horn-type circular waveguides 154 formed in the horn-type circular waveguide plate 151 are structured by the cylinder-form portions 154*b* and cone-form portions 154*a* joining at boundary lines 155. In the present embodiment however, as shown in FIGS. 23A and 23B, portions corresponding to the cylinder-form portions 154*b* are not present. Accordingly, the horn-type circular waveguide plate 161 is thinner by a thickness corresponding to such cylinder-form portions.

Now, operation of the circular waveguide array antenna which illustrates the twelfth embodiment of the present invention is the same as operation of the circular waveguide array antenna of the eleventh embodiment, and descriptions will not be given. However, in the case of the eleventh embodiment, the cylinder-form portions 154*b* are present, and the cylinder-form portions 154*b* are non-lossy waveguides. Therefore, the electromagnetic waves are propagated in amounts corresponding to the cylinder-form portions 154*b* that are present and, although phase is delayed in correspondence with distances of the cylinder-form portions 154*b*, there is no effect on antenna characteristics. In the case of the twelfth embodiment, there are no cylinder-form portions, there is no delay in phase of the electromagnetic waves which are propagated inside the antenna, and there is no effect at all on antenna characteristics.

That is, as long as portions corresponding to the forms of the boundary lines 155 of the eleventh embodiment are circular with a diameter the same as the diameter of the cylinder-form portions, the cylinder-form portions may be eliminated.

As described above, the cylinder-form portions are removed from the horn-type circular waveguides of the horn-type circular waveguide plate 161, and only conical-form horns are structured. Therefore, thickness of the horn-type circular waveguide plate 161 can be made thinner by an amount corresponding to cylindrical portions of the horn-type circular waveguides of the array elements, and a further reduction in size and reduction in weight of the circular waveguide array antenna are enabled.

Moreover, an increase in functionality and a reduction in price of the circular waveguide array antenna are enabled.

Here, because the circular waveguide array antenna of the present embodiment has similar characteristics to the circular waveguide array antenna of the eleventh embodiment, applications are the same as the applications mentioned for the eleventh embodiment.

Thirteenth Embodiment

The present embodiment adds the horn-type circular waveguide plate 151 which acts as the upper portion openings of the array elements of the eleventh embodiment (FIGS. 21A and 21B) onto the circular waveguide plate 41 which acts as upper portion openings of array elements of the conventional circular waveguide array antenna (FIGS. 31A and 31B). In accordance with requirements, a single antenna can be employed as a circular waveguide array antenna as conventionally or can be employed as a horn-type circular waveguide array antenna as in the eleventh embodiment.

Figure 24:
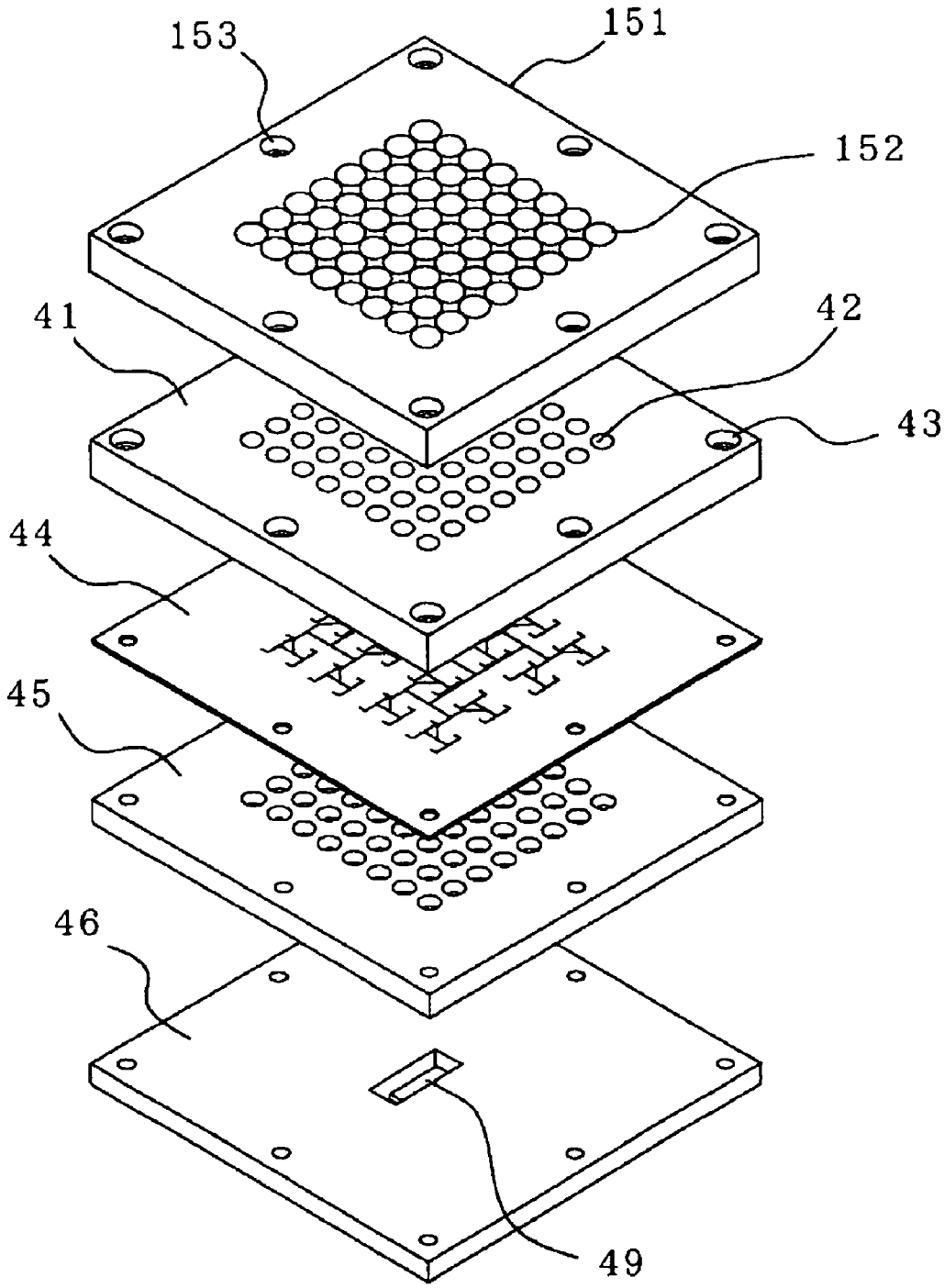
FIG. 24 is an exploded perspective view of a circular waveguide array antenna which illustrates a thirteenth embodiment of the present invention.
Figure 25:
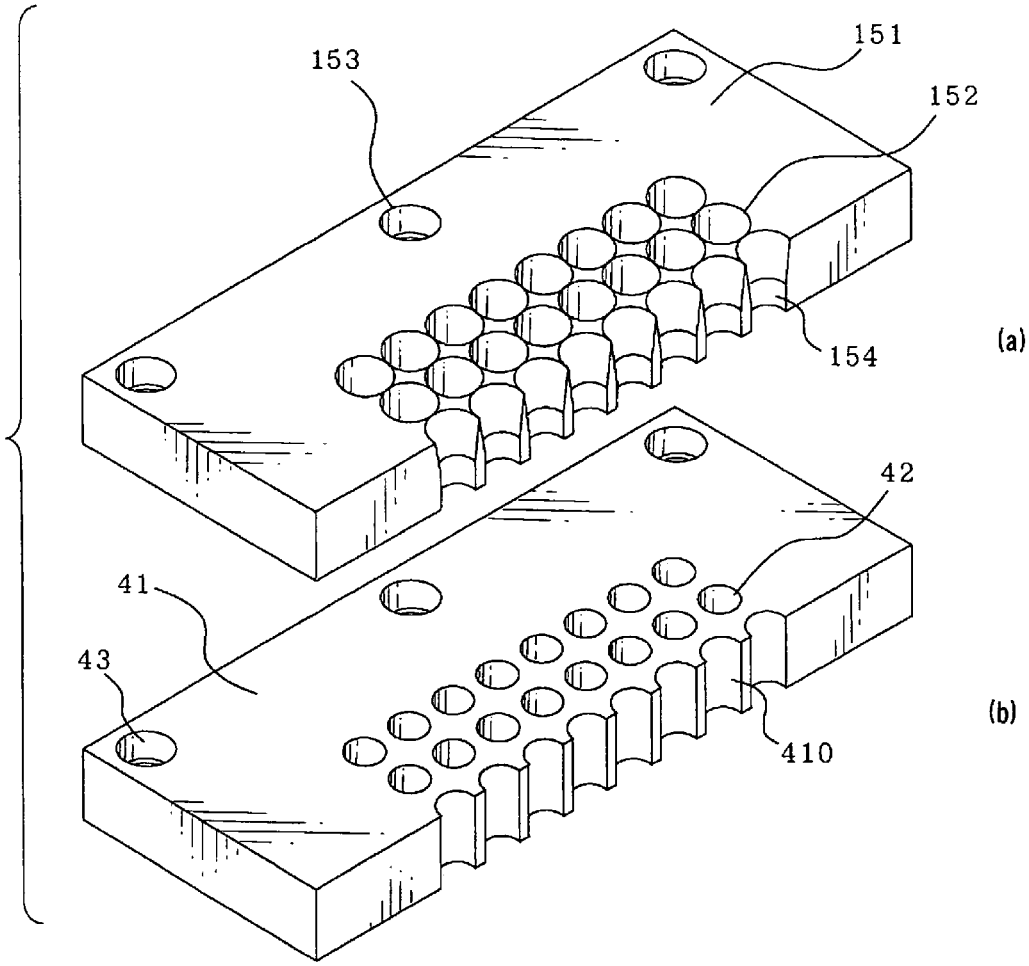
FIG. 25 is a perspective view prior to assembly of a horn-type circular waveguide plate of the circular waveguide array antenna which illustrates the thirteenth embodiment of the present invention.
Figure 26:
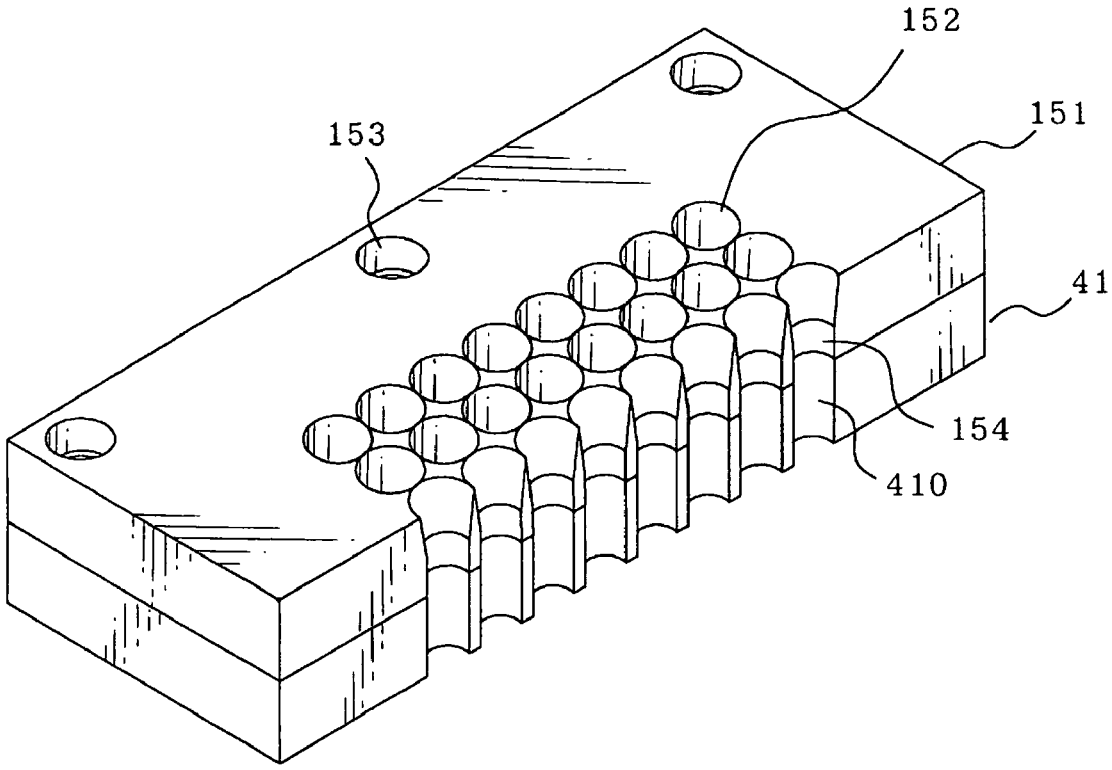
FIG. 26 is a perspective view subsequent to assembly of the horn-type circular waveguide plate of the circular waveguide array antenna which illustrates the thirteenth embodiment of the present invention.

FIG. 24 is an exploded perspective view of a circular waveguide array antenna. FIG. 25 ((*a*), (*b*)) is a perspective view of a horn-type circular waveguide plate of FIG. 24. FIG. 25 (*a*) is a perspective sectional view of the horn-type circular waveguide plate of the eleventh embodiment, and FIG. 25 (*b*) is a perspective sectional view of a circular waveguide plate of a conventional circular waveguide array antenna. FIG. 26 is a perspective sectional view of the circular waveguide plate after assembly.

With FIGS. 24 to 26, portions the same as or corresponding to FIGS. 21A and 21B of the eleventh embodiment or FIGS. 31A and 31B of the conventional example are assigned the same reference numerals and will not be described.

In FIG. 24, the horn-type circular waveguide plate 151 of the eleventh embodiment is disposed on the circular waveguide plate 41 of the conventional circular waveguide array antenna, and the horn-type circular waveguide plate 151 is fixed by bolts passing through the fixing screw holes 153 and 43 such that arrangements of the openings 42 of the circular waveguide plate 41 and the array element openings 152 formed in the horn-type circular waveguide plate 151 coincide. Thus, the horn-type circular waveguide plate 151 and the circular waveguide plate 41 can be employed as a horn-type circular waveguide array antenna.

Because this structure is similar to the horn-type circular waveguide plate 151 of the eleventh embodiment, operation of the circular waveguide array antenna of the thirteenth embodiment is identical to operation of the circular waveguide array antenna of the eleventh embodiment.

As described above, the circular waveguide array antenna of the present embodiment retains the structure of the conventional circular waveguide array antenna and attaches the horn-type circular waveguide plate 151 illustrated in the eleventh embodiment thereto. Thus, when employment as a conventional circular waveguide array antenna is required, it is sufficient to detach the horn-type circular waveguide plate 151.

Accordingly, the circular waveguide array antenna of the present embodiment can, depending on usage conditions, fulfill the functions of the circular waveguide array antenna of the eleventh embodiment and the conventional circular waveguide array antenna, and a circular waveguide array antenna with higher functionality and lower price can be achieved.

Because characteristics of the circular waveguide array antenna of the present embodiment are also the same as for the circular waveguide array antenna of the eleventh embodiment, applications are the same as the applications mentioned for the eleventh embodiment.

Fourteenth Embodiment

The present embodiment adds the horn-type circular waveguide plate 161 which acts as the upper portion openings of the array elements of the twelfth embodiment (FIGS. 23A and 23B) onto the circular waveguide plate 41 which acts as the upper portion openings of the array elements of the conventional circular waveguide array antenna (FIGS. 31A and 31B). In accordance with requirements, a single antenna can be employed as a circular waveguide array antenna as conventionally or can be employed as a horn-type circular waveguide array antenna as in the eleventh embodiment.

Figure 27:
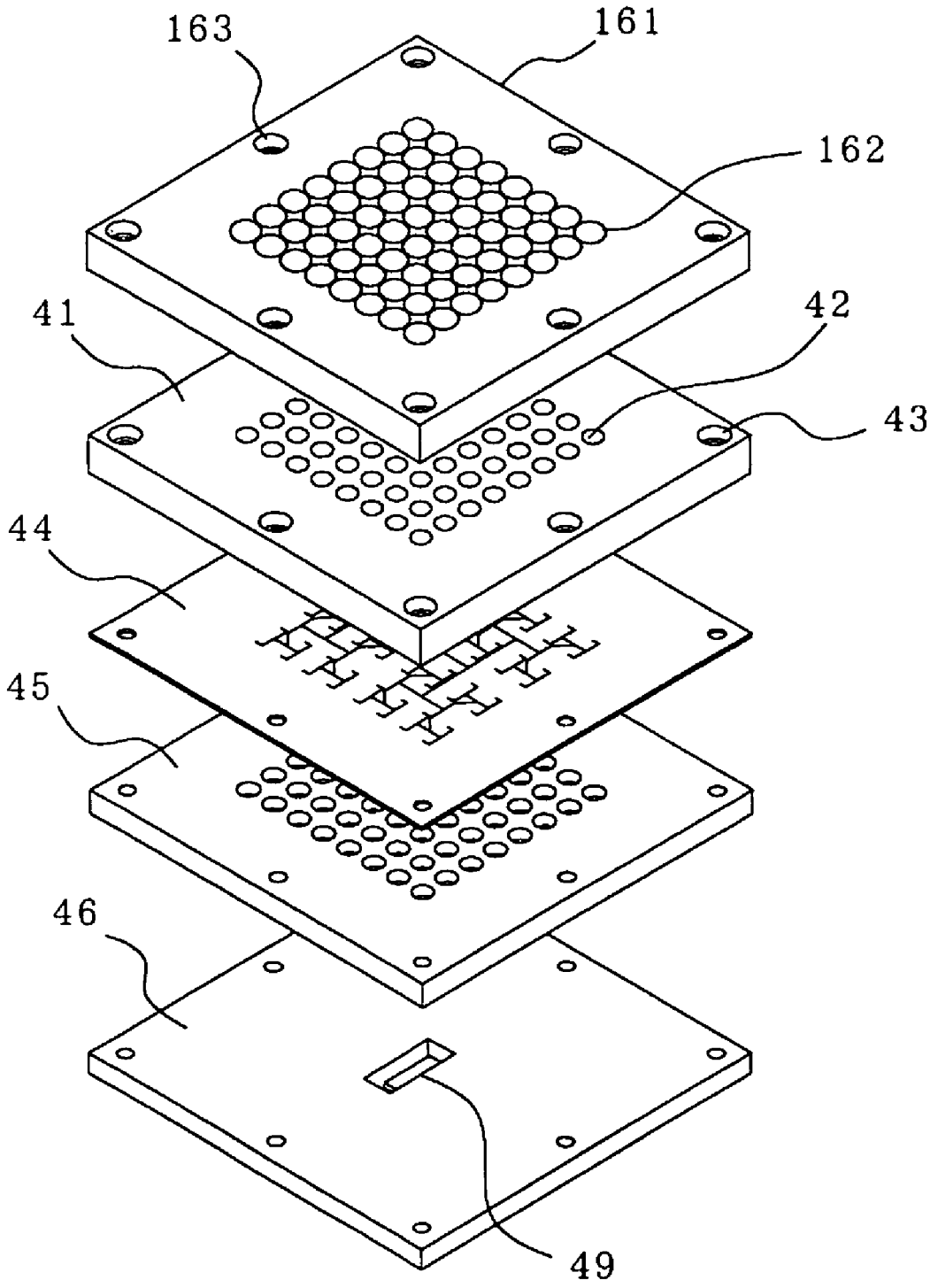
FIG. 27 is an exploded perspective view of a circular waveguide array antenna which illustrates a fourteenth embodiment of the present invention.
Figure 28:
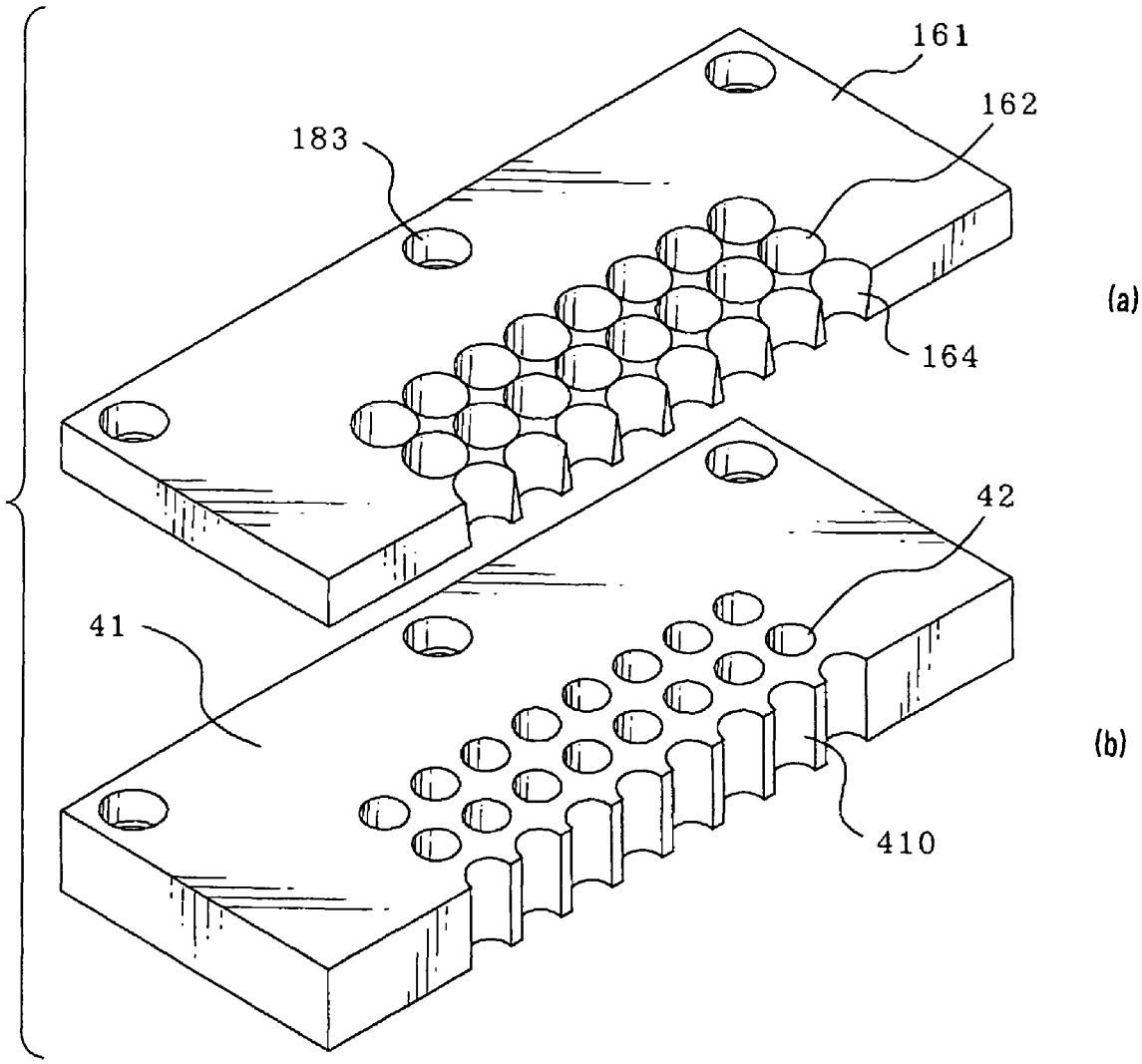
FIG. 28 is a perspective view prior to assembly of a horn-type circular waveguide plate of the circular waveguide array antenna which illustrates the fourteenth embodiment of the present invention.
Figure 29:
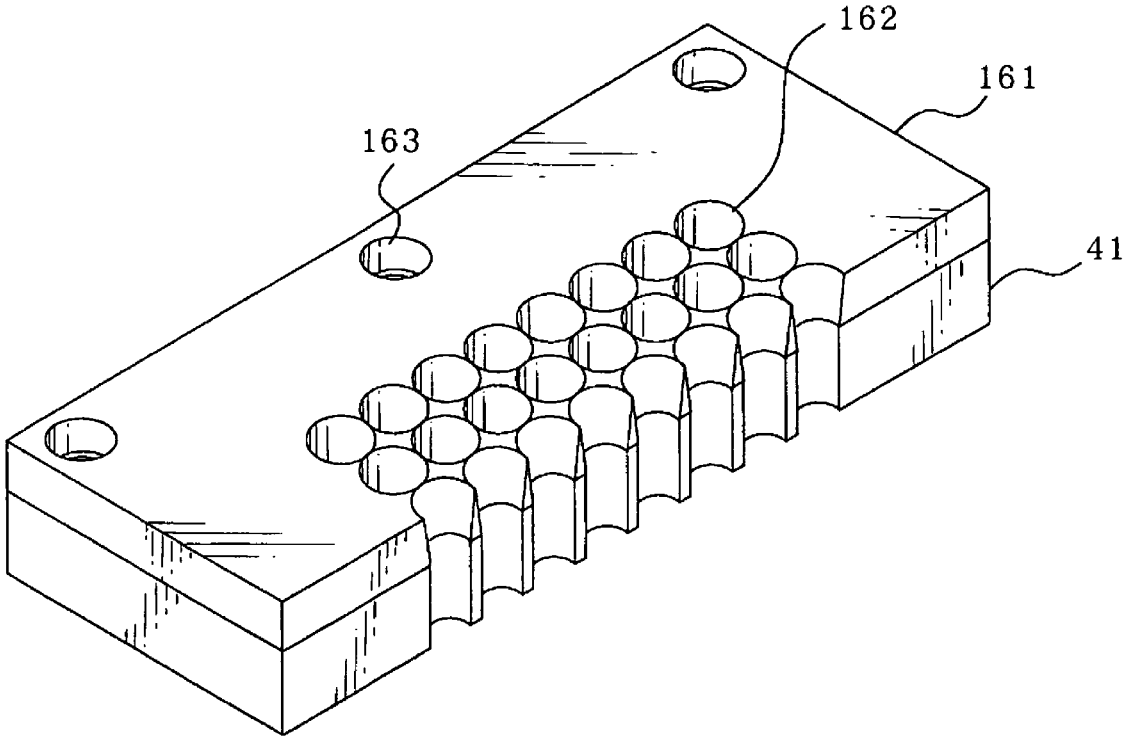
FIG. 29 is a perspective view subsequent to assembly of the horn-type circular waveguide plate of the circular waveguide array antenna which illustrates the fourteenth embodiment of the present invention.

FIG. 27 is an exploded perspective view of a circular waveguide array antenna. FIG. 28 ((*a*), (*b*)) is a perspective view of a horn-type circular waveguide plate. FIG. 28 (*a*) is a perspective sectional view of the horn-type circular waveguide plate of the fourteenth embodiment and FIG. 28 (*b*) of the circular waveguide plate of the conventional circular waveguide array antenna. FIG. 29 is a perspective sectional view of the circular waveguide plate after assembly.

With FIGS. 27 to 29, portions the same as or corresponding to FIGS. 23A and 23B of the twelfth embodiment or FIGS. 31A and 31B of the conventional example are assigned the same reference numerals and will not be described.

In FIG. 27, the horn-type circular waveguide plate 161 of the twelfth embodiment is disposed on the circular waveguide plate 41 of the conventional circular waveguide array antenna, and the horn-type circular waveguide plate 161 is fixed by bolts passing through the fixing screw holes 163 and 43 such that arrangements of the openings 42 of the circular waveguide plate 41 and the array element openings 162 formed in the horn-type circular waveguide plate 161 coincide. Thus, the horn-type circular waveguide plate 161 and the circular waveguide plate 41 are integrated, to form a structure similar to the horn-type circular waveguide plate 151 of the eleventh embodiment, and this can be employed as a horn-type circular waveguide array antenna.

Because this structure is similar to the horn-type circular waveguide plate 151 of the eleventh embodiment, operation of the circular waveguide array antenna of the present embodiment is identical to operation of the circular waveguide array antenna of the eleventh embodiment.

As described above, the circular waveguide array antenna of the present embodiment retains the structure of the conventional circular waveguide array antenna and attaches the horn-type circular waveguide plate 161 illustrated in the twelfth embodiment thereto. Thus, when employment as the conventional circular waveguide array antenna is required, it is sufficient to detach the horn-type circular waveguide plate 161.

Consequently, the circular waveguide array antenna of the present embodiment can, depending on usage conditions, fulfill the functions of the circular waveguide array antenna of the eleventh embodiment and the conventional circular waveguide array antenna, and a circular waveguide array antenna with higher functionality and lower price can be achieved.

Because characteristics of the circular waveguide array antenna of the present embodiment are also the same as for the circular waveguide array antenna of the eleventh embodiment, applications are the same as the applications mentioned for the eleventh embodiment.

Fifteenth Embodiment

For this embodiment, while a plate of a horn-type circular waveguide plate of the seventh to fourteenth embodiments, which acts as array element openings of a circular waveguide array antenna of the present invention, is fabricated by mechanically machining a brass material, an aluminium material or a conductive plastic material with a lathe, a drilling machine or the like, the present embodiment is a structure fabricated by molding a plastic to which conductivity has been applied or by applying conductivity to an already-molded product of plastic.

For a plastic molded product to which conductivity is applied, an engineering plastic with extremely good characteristics of mechanical strength, endurance and consistency over time, such as, for example, a polysulfone, polyethersulfone, polyphenylenesulfide, polyetherether ketone, polyarylate, polyetherimide or the like, is employed. The application of conductivity involves applying a carbon agent or a conductive coating or the like to the array element horn-type circular waveguide plate which has been fabricated by plastic molding, or vapor depositing or plating a metal film of aluminium, gold or the like.

Anyway, it is possible to fabricate the array element horn-type circular waveguide plate by molding a conductive plastic such as, for example, polyacetylene, polyaniline, polythiophene, polypyrrole, or another polymer or the like, with subsequent application of conductivity being rendered unnecessary.

As described above, the present embodiment simply changes the plate of the horn-type circular waveguide of the seventh to fourteenth embodiments, which acts as the upper portion openings of the array elements of the circular waveguide array antenna of the present invention, to a material moldable from a brass material, an aluminium material or a conductive plastic material, or the like. Therefore, operations of circular waveguide array antennas are identical to the circular waveguide array antennas of the respective embodiments.

As described above, according to the present embodiment, the array element horn-type circular waveguide plate employs a brass material, an aluminium material, a conductive plastic material or the like, and there is no need for fabrication with complex lathing. Therefore, mass production is easier, and a reduction in price and a reduction in weight can be achieved.

What is claimed is:

1. A circular waveguide antenna comprising:

a circular waveguide;

a feeding portion at one end of a circular waveguide, the feeding portion feeding electromagnetic waves; and a radiation aperture at an opposite end of the circular waveguide, the radiation aperture radiating the electromagnetic waves, wherein the circular waveguide includes a conical horn, with a diameter of a feeding side aperture at the feeding portion end being a , a diameter of the radiation aperture being d, which is larger than the diameter a of the feeding side aperture, and an opening angle being $2\alpha$, and if a wavelength of a central frequency of an employed frequency band is $\lambda$, then a value $\alpha$, which is half of the opening angle $2\alpha$, the diameter d of the radiation aperture and the value of the wavelength $\lambda$ of the central frequency of the employed frequency band are at least one of set in predetermined ranges and set such that α, d and λ satisfy a predetermined relationship with one another.

2. The circular waveguide antenna of claim 1, wherein the value of α is between 0.8× Arcsin(0.1349114/(d/λ)) and 1.2× Arcsin(0.1349114/(d/λ)).

3. The circular waveguide antenna of claim 2, wherein the circular waveguide is formed in a horn-type circular waveguide plate; the conical horn thereof being formed in a conductive plate in the horn-type circular waveguide plate with a predetermined thickness, and the feeding portion includes a stripline circuit sheet at which a stripline is formed to correspond with the conical horn of the horn-type circular waveguide plate, a reflection plate in which a cylindrical cavity for electromagnetic wave reflection is formed, and a feeding opening plate in which a feeding opening is formed.

4. A circular waveguide array antenna, in which the conical horn of the horn-type circular waveguide plate of claim 3 is plurally arranged, and the stripline of the stripline circuit sheet is plurally formed to correspond with the conical horns.

5. The circular waveguide array antenna of claim 4, wherein a spacing of neighboring conical horns is substantially equal to the wavelength λ.

6. The circular waveguide array antenna of claim 4, wherein the conical horns are arranged in one of a row and a two-dimensional plane.

7. The circular waveguide array antenna of claim 4, wherein the conical horns of the horn-type circular waveguide plate are formed without cylindrical portions.

8. The circular waveguide array antenna of claim 4, wherein conductive structural members of the horn-type circular waveguide plate and the feeding portion respectively employ at least one material selected from the group consisting of metals, plastic materials with conductivity, materials molded of a resin with conductivity, dielectrics at a surface of which a layer with conductivity is formed, and insulative materials at a surface of which a layer with conductivity is formed.

9. The circular waveguide antenna of claim 1, wherein the value of α is substantially equal to Arcsin(0.1349114/(d/λ)).

10. The circular waveguide antenna of claim 1, wherein the value of α is between 7.753°-2° and 7.753°+2°.

11. The circular waveguide antenna of claim 1, wherein the radiation aperture diameter d is substantially equal to the wavelength λ, and the value of α is substantially equal to 7.753°.

12. The circular waveguide antenna of claim 1, wherein the value of a ratio d/b-λ, between the diameter d of the aperture which radiates electromagnetic waves and the wavelength λ of the central frequency, is between approximately 2.0 and approximately 6.5, and the value of α is between approximately 15° and approximately 45°.

13. The circular waveguide antenna of claim 1, wherein the value of a ratio d/d/λ, between the diameter d of the aperture which radiates electromagnetic waves and the wavelength λ of the central frequency, is not more than approximately 1, and radiation gain is substantially constant with respect to changes in the value of the opening angle 2α.

14. The circular waveguide antenna of claim 1, wherein the feeding portion comprises a stripline, the stripline including a single propagation path which protrudes a predetermined length toward a center of the feeding side aperture of the circular waveguide, such that linearly polarized electromagnetic waves are radiated.

15. The circular waveguide antenna of claim 1, wherein the feeding portion comprises a stripline, the stripline including:

an input propagation path; and a left propagation path and a right propagation path which, viewed from the side of the circular waveguide of the aperture which radiates the electromagnetic waves, branch to left and right from the input propagation path along an outer side of the feeding side aperture of the circular waveguide, with widths which are narrower than the input propagation path, respective distal ends of the left propagation path and the right propagation path extending perpendicularly towards a center of the circular waveguide and protruding to predetermined lengths towards the center, such that circularly polarized electromagnetic waves are radiated.

16. The circular waveguide antenna of claim 15, wherein a total length of the left propagation path is shorter than a total length of the right propagation path by a quarter of a wavelength in the stripline λg, such that left-handed helically polarized electromagnetic waves are radiated.

17. The circular waveguide antenna of claim 15, wherein a total length of the right propagation path is shorter than a total length of the left propagation path by a quarter of a wavelength in the stripline λg, such that right-handed helically polarized electromagnetic waves are radiated.

18. The circular waveguide antenna of claim 1, wherein the feeding portion comprises a stripline, the stripline including:

an input propagation path; and a left propagation path and a right propagation path which, viewed from the side of the circular waveguide of the aperture which radiates the electromagnetic waves, branch to left and right from the input propagation path along an outer side of the feeding side aperture of the circular waveguide, respective distal ends of the left propagation path and the right propagation path extending perpendicularly towards a center of the circular waveguide and protruding to predetermined lengths towards the center, wherein the left propagation path and the right propagation path each includes an impedance alteration step at a position a predetermined length from a point of branching from the input propagation path, a width from the branching point to the impedance alteration step being approximately half a width of the input propagation path, and a width from the impedance alteration step to the distal end being substantially the same as the width of the input propagation path.

19. The circular waveguide antenna of claim 18, wherein a total length of the left propagation path is shorter than a total length of the right propagation path by a quarter of a wavelength in the stripline λg, such that left-handed helically polarized electromagnetic waves are radiated.

20. The circular waveguide antenna of claim 18, wherein a total length of the right propagation path is shorter than a total length of the left propagation path by a quarter of a wavelength in the stripline λg, such that right-handed helically polarized electromagnetic waves are radiated.

21. A circular waveguide array antenna comprising:

a circular waveguide plate, in which a plurality of cylindrical waveguides which include radiation apertures are formed in a conductive plate with a predetermined thickness; and a feeding portion which includes a stripline circuit sheet formed to correspond with the circular waveguides of the circular waveguide plate, a reflection plate in which cylindrical cavities for electromagnetic wave reflection are formed, and a feeding opening plate in which feeding openings are formed, wherein the horn-type circular waveguide plate of claim 18 is removably attached to the radiation aperture side of the circular waveguide plate such that the conical horns of the horn-type circular waveguide plate coincide with the circular waveguides of the circular waveguide plate.

* * * * *